US011242759B2

(12) United States Patent
Wakazono et al.

(10) Patent No.: US 11,242,759 B2
(45) Date of Patent: Feb. 8, 2022

(54) TURBINE BLADE AND GAS TURBINE

(71) Applicant: Mitsubishi Power, Ltd., Yokohama (JP)

(72) Inventors: Susumu Wakazono, Yokohama (JP); Keita Takamura, Yokohama (JP); Satoshi Hada, Yokohama (JP)

(73) Assignee: MITSUBISHI POWER, LTD., Kanagawa (JP)

( * ) Notice: Subject to any disclaimer, the term of this patent is extended or adjusted under 35 U.S.C. 154(b) by 0 days.

(21) Appl. No.: 17/043,869

(22) PCT Filed: Apr. 12, 2019

(86) PCT No.: PCT/JP2019/015994
§ 371 (c)(1),
(2) Date: Sep. 30, 2020

(87) PCT Pub. No.: WO2019/203158
PCT Pub. Date: Oct. 24, 2019

(65) Prior Publication Data

US 2021/0025279 A1 Jan. 28, 2021

(30) Foreign Application Priority Data

Apr. 17, 2018 (JP) ..... JP2018-078907

(51) Int. Cl.
*F01D 5/18* (2006.01)

(52) U.S. Cl.
CPC ..... *F01D 5/187* (2013.01); *F05D 2220/321* (2013.01); *F05D 2260/2212* (2013.01); *F05D 2260/22141* (2013.01)

(58) Field of Classification Search
CPC . F01D 5/187; F01D 9/023; F02C 7/18; F05D 2220/321; F05D 2220/32;
(Continued)

(56) References Cited

U.S. PATENT DOCUMENTS 4,180,373 A * 12/1979 Moore ..... F01D 5/187 415/115
4,278,400 A * 7/1981 Yamarik ..... F01D 5/187 415/115
(Continued)

FOREIGN PATENT DOCUMENTS

JP 55-107005 8/1980
JP 2003-193805 7/2003
(Continued)

OTHER PUBLICATIONS

International Search Report dated Jul. 2, 2019 in corresponding International (PCT) Application No. PCT/JP2019/015994.
(Continued)

*Primary Examiner* — Igor Kershteyn
(74) *Attorney, Agent, or Firm* — Wenderoth, Lind & Ponack, L.L.P.

(57) ABSTRACT

A turbine blade includes: an airfoil body; a cooling passage extending along a blade height direction inside the airfoil body; and a plurality of turbulators disposed on an inner wall surface of the cooling passage and arranged along the cooling passage. The airfoil body has a first end portion and a second end portion which are opposite end portions in the blade height direction. A passage width of the cooling passage in a suction-pressure direction of the airfoil body at the second end portion is greater than a passage width of the cooling passage at the first end portion. A height of the plurality of turbulators increases from a first end portion side to a second end portion side in the blade height direction.

15 Claims, 9 Drawing Sheets

(58) Field of Classification Search
CPC ..... F05D 2250/185; F05D 2250/314; F05D 2260/2212; F05D 2260/22141
See application file for complete search history.

(56) References Cited

U.S. PATENT DOCUMENTS

| | | | | |
|---|---|---|---|---|
| 5,232,343 | A * | 8/1993 | Butts | F01D 5/187 415/115 |
| 5,695,320 | A | 12/1997 | Kercher | |
| 5,695,321 | A * | 12/1997 | Kercher | F01D 5/187 416/97 R |
| 5,700,132 | A * | 12/1997 | Lampes | F01D 5/187 416/97 R |
| 5,738,493 | A | 4/1998 | Lee et al. | |
| 6,089,826 | A * | 7/2000 | Tomita | F01D 5/187 415/115 |
| 6,227,804 | B1 * | 5/2001 | Koga | F01D 5/187 415/115 |
| 6,290,462 | B1 * | 9/2001 | Ishiguro | F01D 5/187 416/97 R |
| 6,672,836 | B2 | 1/2004 | Merry | |
| 2003/0108422 | A1 | 6/2003 | Merry | |
| 2004/0146402 | A1 | 7/2004 | Soechting et al. | |
| 2008/0170945 | A1 | 7/2008 | Barrett | |
| 2009/0041587 | A1 * | 2/2009 | Konter | F01D 5/187 416/97 R |

FOREIGN PATENT DOCUMENTS

| | | |
|---|---|---|
| JP | 2004-225690 | 8/2004 |
| JP | 4063937 | 3/2008 |

OTHER PUBLICATIONS

International Preliminary Report on Patentability dated Oct. 29, 2020 in corresponding International (PCT) Application No. PCT/JP2019/015994, with English Translation.

* cited by examiner

TURBINE BLADE AND GAS TURBINE

TECHNICAL FIELD

The present disclosure relates to a turbine blade and a gas turbine.

BACKGROUND

In a turbine blade of a gas turbine or the like, it is known that the turbine blade exposed to high-temperature gas flow is cooled by flowing a cooling fluid through a cooling passage formed inside the turbine blade. On an inner wall surface of the cooling passage, a rib turbulator may be provided to promote turbulence of the cooling fluid flowing through the cooling passage in order to improve heat transfer rate between the cooling fluid and the turbine blade.

For example, Patent Document 1 discloses a turbine blade including a plurality of turbulators arranged along the flow direction of cooling fluid on the inner wall surface of the cooling passage extending along the blade height direction.

CITATION LIST

Patent Literature

Patent Document 1: JP2004-225690A

SUMMARY

Problems to be Solved

In recent years, for example in a gas turbine, the load acting on the turbine blade tends to increase with increasing output power. In order to improve the strength of the turbine blade to withstand the increasing load, the blade width in the suction-pressure direction of the turbine blade on one side in the radial direction of the turbine (i.e., blade height direction of turbine blade) is often designed to be greater than the blade width on the other side.

When the width in the suction-pressure direction of the turbine blade is increased on one side in the radial direction, the width (or flow-passage cross-sectional area) of the cooling passage formed inside the turbine blade may be also increased on the same side in the radial direction.

It is desired to select an appropriate turbulator in response to the change in the blade width of the turbine blade to achieve a blade structure with optimized internal cooling passage.

In view of the above, an object of at least one embodiment of the present invention is to provide a turbine blade and a gas turbine that enable efficient cooling.

Solution to the Problems (1) A turbine blade according to at least one embodiment of the present invention comprises: an airfoil body having a first end portion and a second end portion which are opposite end portions in a blade height direction; a cooling passage extending along the blade height direction inside the airfoil body; and a plurality of turbulators disposed on an inner wall surface of the cooling passage and arranged along the cooling passage. A passage width of the cooling passage in a suction-pressure direction of the airfoil body at the second end portion is greater than a passage width of the cooling passage at the first end portion. A height of the plurality of turbulators increases from a first end portion side to a second end portion side in the blade height direction.

With the above configuration (1), since the height of the turbulators increases from the first end portion side with a relatively small passage width of the cooling passage to the second end portion side with a relatively great passage width of the cooling passage in the blade height direction, the effect of improving the heat transfer rate by the turbulator can be obtained on the second end portion side as much as on the first end portion side. Further, with the above configuration (1), since the height of the turbulator is relatively small on the first end portion side in the blade height direction, it is possible to suppress pressure loss due to the presence of the turbulator on the first end portion side where the pressure loss tends to increase due to a relatively narrow passage width of the cooling passage. Thus, with the above configuration (1), it is possible to efficiently cool the turbine blade having a passage width of the cooling passage varying along the blade height direction.

(2) In some embodiments, in the above configuration (1), a relationship of $0.5 \leq (e/D)/(e/D)_{AVE} \leq 2.0$ is satisfied, where (e/D) is a ratio of a height e of each of the plurality of turbulators to a passage width D of the cooling passage in the suction-pressure direction at a position of the turbulator in the blade height direction, and $(e/D)_{AVE}$ is an average of the ratio (e/D) of the plurality of turbulators.

With the above configuration (2), since the ratio (e/D) of the turbulator height e to the passage width D of a turbulator of the plurality of turbulators disposed in the cooling passage is set to a value close to $(e/D)_{AVE}$ which is an average of (e/D) of all turbulators disposed in the cooling passage, it is possible to suppress a rapid change of an increase in pressure loss and a reduction in heat transfer rate along the blade height direction. Thus, it is possible to effectively cool the turbine blade.

(3) In some embodiments, in the above configuration (1) or (2), a relationship of $1.5 \leq (D2/D1)$ is satisfied, where D1 is a passage width of the cooling passage at a position of a turbulator closest to the first end portion in the blade height direction among the plurality of turbulators, D2 is a passage width of the cooling passage at a position of a turbulator closest to the second end portion in the blade height direction among the plurality of turbulators, and (D2/D1) is a ratio of the passage width D2 to the passage width D1.

With the above configuration (3), in the turbine blade in which the passage width D2 of the cooling passage on the second end portion side is significantly greater than the passage width D1 of the cooling passage on the first end portion side, the height of the turbulator is increased at a position in the blade height direction on the second end portion side with a great passage width of the cooling passage. Thus, it is possible to efficiently cool the turbine blade as described in the above (1).

(4) In some embodiments, in any one of the above configurations (1) to (3), a pitch in the blade height direction between a pair of turbulators which are adjacent in the blade height direction increases from the first end portion toward the second end portion in the blade height direction.

The effect of improving the heat transfer rate by the turbulator varies with the pitch between turbulators adjacent in the blade height direction, and there is a ratio of the pitch to the height of the turbulator which provides high heat transfer rate. In this regard, with the above configuration (4), the pitch between turbulators adjacent in the blade height direction increases from the first end portion toward the second end portion in the blade height direction, i.e., as the height of the turbulators increases. Thus, high heat transfer rate can be obtained in a blade-height-directional range in which the turbulators are disposed in the cooling passage.

(5) In some embodiments, in any one of the above configurations (1) to (4), a relationship of $0.5 \leq (P/ea)/(P/ea)_{AVE} \leq 2.0$ is satisfied, where (P/ea) is a ratio of a pitch P between a pair of turbulators which are adjacent in the blade height direction among the plurality of turbulators to an average height ea of the pair of turbulators, and $(P/ea)_{AVE}$ is an average of the ratio (P/ea) of the plurality of turbulators.

With the above configuration (5), (P/ea) of a pair of turbulators among the plurality of turbulators disposed in the cooling passage is set to a value close to $(P/ea)_{AVE}$ which is an average of (P/ea) of the plurality of turbulators disposed in the cooling passage. Thus, the pitch between the adjacent turbulators tends to increase from the first end portion toward the second end portion in the blade height direction, i.e., as the height of the turbulators increases. Thus, by appropriately setting (P/ea) or $(P/ea)_{AVE}$, it is possible to achieve high heat transfer rate in the blade-height-directional range where the turbulators are disposed in the cooling passage.

(6) In some embodiments, in any one of the above configurations (1) to (5), the cooling passage is one of a plurality of passes constituting a serpentine passage formed inside the airfoil body.

With the above configuration (6), in the turbine blade having the serpentine passage as the internal passage for the cooling fluid, the pass constituting the serpentine passage is the cooling passage having the above configuration (1). Thus, it is possible to obtain the effect of improving the heat transfer rate by the turbulator on the second end portion side of the pass (cooling passage) as much as on the first end portion side. In addition, it is possible to suppress pressure loss due to the presence of the turbulator on the first end portion side where the pressure loss tends to increase due to a relatively narrow passage width of the pass (cooling passage). Thus, with the above configuration (6), it is possible to efficiently cool the turbine blade having a passage width of the pass (cooling passage) of the serpentine passage varying along the blade height direction.

(7) In some embodiments, in the above configuration (6), the cooling passage is a pass other than a last pass which is closest to a trailing edge among the plurality of passes constituting the serpentine passage. The turbine blade comprises a plurality of last-pass turbulators disposed on suction-side and pressure-side inner wall surfaces of the last pass and arranged along the blade height direction. When e is a height of each turbulator or each last-pass turbulator, and D is a passage width of the cooling passage or the last pass in the suction-pressure direction at a position of the turbulator or the last-pass turbulator in the blade height direction, a relationship of $[(e/D)_{E1}/(e/D)_{AVE}] \leq [(e/D)_{T_E1}/(e/D)_{T_AVE}]$ is satisfied, where $(e/D)_{E1}$ is a ratio of the height to the passage width of a turbulator closest to the first end portion in the blade height direction among the plurality of turbulators, $(e/D)_{AVE}$ is an average of a ratio (e/D) of the height to the passage width of the plurality of turbulators, $(e/D)_{T_E1}$ is a ratio of the height to the blade width of a last-pass turbulator closest to the first end portion in the blade height direction among the plurality of last-pass turbulators, and $(e/D)_{T_AVE}$ is an average of a ratio $(e/D)_T$ of the height to the blade width of the plurality of last-pass turbulators.

As described in the above (1), regarding the turbulators disposed in the pass (cooling passage) other than the last pass, since the height of the turbulators increases from the first end portion side with a relatively narrow passage width of the cooling passage to the second end portion side with a relatively wide passage width of the cooling passage, the ratio (e/D) of the height e of the turbulator to the passage width D tends to be constant (i.e., the left side of the above relational expression is close to 1). Accordingly, the above relational expression indicates that, in the last pass, from the second end portion side to the first end portion side in the blade height direction, the passage width D of the last pass decreases, but the height e of the last-pass turbulators does not decrease as much as the passage width D.

That is, with the above configuration (7), the height e of the plurality of last-pass turbulators in the last pass of the serpentine passage does not change so much in the blade height direction. Therefore, in the last pass where the cooling fluid has a relatively high temperature in the serpentine passage, it is possible to increase the flow velocity of the cooling fluid on the first end portion side, which is generally downstream with respect to the cooling fluid flow. Thus, it is possible to more effectively cool the turbine blade by the cooling fluid flowing through the last pass.

(8) In some embodiments, in any one of the above configurations (1) to (7), the cooling passage is a pass other than a last pass which is closest to a trailing edge among a plurality of passes constituting a serpentine passage formed inside the airfoil body. The turbine blade comprises a plurality of last-pass turbulators disposed on suction-side and pressure-side inner wall surfaces of the last pass and arranged along the blade height direction. A height of each last-pass turbulator of the last pass in the blade height direction with reference to the second end portion is less than a height of a turbulator, disposed at the same position as the last-pass turbulator in the blade height direction, of another pass positioned on an upstream side in a cooling fluid flow direction.

With the above configuration (8), when comparing the heights of the last-pass turbulator and the turbulator of the other pass in the same position in the blade height direction, the height of the last-pass turbulator is less than the height of the turbulator of the other pass. Thus, it is possible to suppress the occurrence of excessive pressure loss applied to the cooling fluid flowing through the last pass while maintaining high heat transfer rate of the last-pass turbulator.

(9) In some embodiments, in any one of the above configurations (1) to (8), the cooling passage is a pass other than a last pass which is closest to a trailing edge among a plurality of passes constituting a serpentine passage formed inside the airfoil body. The turbine blade comprises a plurality of last-pass turbulators disposed on suction-side and pressure-side inner wall surfaces of the last pass and arranged along the blade height direction. A height of each last-pass turbulator of the last pass is less than a height of each turbulator of an upstream cooling passage positioned adjacent to an upstream side of the last pass in a cooling fluid flow direction and communicating with the last pass, among the plurality of passes.

With the above configuration (9), since the height of the turbulator (last-pass turbulator) of the last pass which is closest to the trailing edge in the serpentine passage is less than the height of the turbulator of the upstream cooling passage adjacent to and communicating with the last pass, in the last pass where the flow passage area is relatively narrow and the cooling fluid has a relatively high temperature among the plurality of passes constituting the serpentine passage, a large number of turbulators can be arranged. Thus, it is possible to more effectively cool the turbine blade by the cooling fluid flowing through the last pass.

(10) In some embodiments, in any one of the above configurations (1) to (9), the turbine blade further comprises:

a leading-edge-side passage disposed inside the airfoil body on a leading edge side of the airfoil body with respect to the cooling passage, and extending along the blade height direction, and a plurality of leading-edge-side turbulators disposed on an inner wall surface of the leading-edge-side passage and arranged along the blade height direction. When e is a height of each turbulator or each leading-edge turbulator, and D is a passage width of the cooling passage or the leading-edge-side passage in the suction-pressure direction at a position of the turbulator or the leading-edge-side turbulator in the blade height direction, a relationship of $[(e/D)_{E2}/(e/D)_{AVE}]>[(e/D)_{L_E2}/(e/D)_{L_AVE}]$ is satisfied, where $(e/D)_{E2}$ is a ratio of the height to the passage width of a turbulator closest to the second end portion in the blade height direction among the plurality of turbulators, $(e/D)_{AVE}$ is an average of a ratio (e/D) of the height to the passage width of the plurality of turbulators, $(e/D)_{L_E2}$ is a ratio of the height to the blade width of a leading-edges-side turbulator closest to the second end portion in the blade height direction among the plurality of leading-edges-side turbulators, and $(e/D)_{L_AVE}$ is an average of a ratio $(e/D)_L$ of the height to the blade width of the plurality of leading-edges-side turbulators.

As described in the above (1), regarding the turbulators disposed in the cooling passage, since the height of the turbulators increases from the first end portion side with a relatively narrow passage width of the cooling passage to the second end portion side with a relatively wide passage width of the cooling passage, the ratio (e/D) of the height e of the turbulator to the passage width D tends to be constant (i.e., the left side of the above relational expression is close to 1). Accordingly, the above relational expression indicates that, from the first end portion side to the second end portion side in the blade height direction, the passage width D of the last pass increases, but the height e of the leading-edge-side turbulators does not increase as much as the passage width D.

That is, with the above configuration (10), the height e of the plurality of leading-edge-side turbulators in the leading-edge-side passage does not change so much in the blade height direction. Accordingly, in the leading-edge-side passage supplied with the cooling fluid having a relatively low temperature, it is possible to suppress the effect of improving the heat transfer rate by the turbulator on the second end portion side upstream in the cooling fluid flow direction, and suppress the temperature increase of the cooling fluid flowing toward the first end portion side. Thus, it is possible to more effectively cool the turbine blade.

(11) In some embodiments, in any one of the above configurations (1) to (10), a flow-passage cross-sectional area of the cooling passage increases from the first end portion toward the second end portion in the blade height direction.

With the above configuration (11), since the height of the turbulators increases from the first end portion with a relatively small flow-passage cross-sectional area of the cooling passage to the second end portion with a relatively great flow-passage cross-sectional area of the cooling passage in the blade height direction, the effect of improving the heat transfer rate by the turbulator can be obtained on the second end portion side as much as on the first end portion side. Further, with the above configuration (11), since the height of the turbulator is relatively small on the first end portion side in the blade height direction, it is possible to suppress pressure loss due to the presence of the turbulator on the first end portion side where the pressure loss tends to increase due to a relatively small flow-passage cross-sectional area. Therefore, with the above configuration (11), it is possible to efficiently cool the turbine blade having a flow-passage cross-sectional area of the cooling passage varying along the blade height direction.

(12) In some embodiments, in any one of the above configurations (1) to (11), a relationship of $0.5 \leq \theta/\theta_{AVE} \leq 2.0$ is satisfied, where θ is an inclination angle of each of the plurality of turbulators with respect to a cooling fluid flow direction in the cooling passage, and $\theta_{AVE}$ is an average of the inclination angle of the plurality of turbulators.

The effect of improving the heat transfer rate by the turbulator varies with the inclination angle θ of the turbulator with respect to the cooling fluid flow direction in the cooling passage, and there is an inclination angle of the turbulator which provides high heat transfer rate. In this regard, with the above configuration (12), since the inclination angle θ of the turbulators is substantially constant in the blade height direction, it is possible to achieve high heat transfer rate in the blade-height-directional range where the turbulators are disposed in the cooling passage.

(13) In some embodiments, in any one of the above configurations (1) to (12), the turbine blade is a rotor blade, and the first end portion is positioned on a radially outer side of the second end portion.

With the above configuration (13), since the rotor blade of the turbine blade has any one of the above configurations (1) to (12) as the turbine blade, it is possible to efficiently cool the rotor blade. Thus, it is possible to improve the thermal efficiency of the gas turbine.

(14) In some embodiments, in any one of the above configurations (1) to (12), the turbine blade is a stator blade, and the first end portion is positioned on a radially inner side of the second end portion.

With the above configuration (14), since the stator blade of the turbine blade has any one of the above configurations (1) to (12) as the turbine blade, it is possible to efficiently cool the stator blade. Thus, it is possible to improve the thermal efficiency of the gas turbine.

(15) A gas turbine according to at least one embodiment of the present invention comprises: the turbine blade described in any one of the above (1) to (14); and a combustor for producing a combustion gas flowing through a combustion gas passage in which the turbine blade is disposed.

With the above configuration (15), since the turbine blade has any one of the above configurations (1) to (14), it is possible to reduce the amount of the cooling fluid supplied to the serpentine passage for cooling the turbine blade. Thus, it is possible to improve the thermal efficiency of the gas turbine.

Advantageous Effects

According to at least one embodiment of the present invention, the cooling passage of the turbine blade is optimized, so that it is possible to reduce the cooling fluid amount, and improve the thermal efficiency of the turbine.

DETAILED DESCRIPTION

Embodiments of the present invention will now be described in detail with reference to the accompanying drawings. It is intended, however, that unless particularly identified, dimensions, materials, shapes, relative positions, and the like of components described in the embodiments shall be interpreted as illustrative only and not intended to limit the scope of the present invention.

First, a gas turbine to which a turbine blade according to some embodiments is applied will be described.

Figure 1:
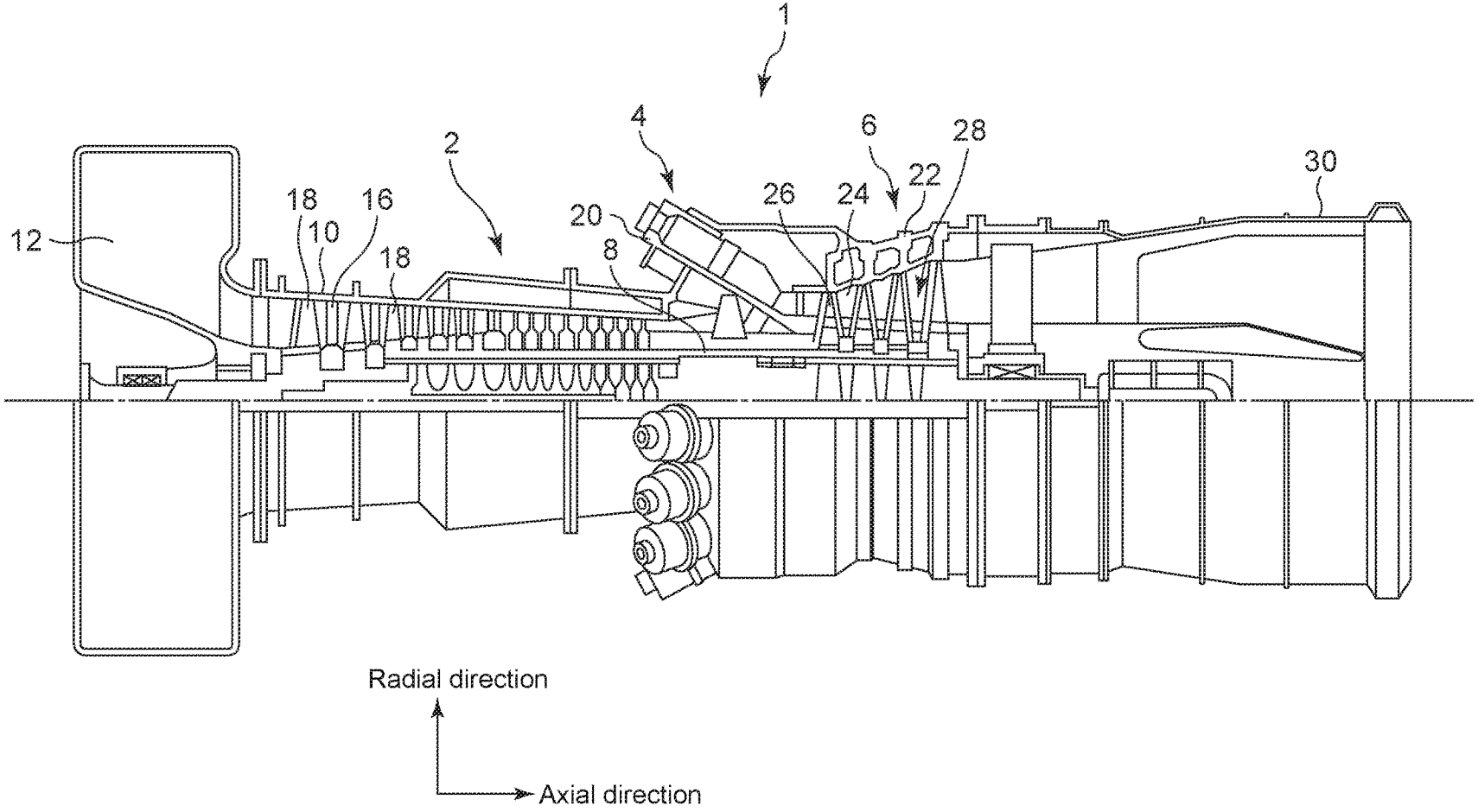
FIG. 1 is a schematic configuration diagram of a gas turbine to which a turbine blade according to an embodiment is applied.

FIG. 1 is a schematic configuration diagram of a gas turbine to which a turbine blade according to an embodiment is applied. As shown in FIG. 1, the gas turbine 1 includes a compressor 2 for producing compressed air, a combustor 4 for producing a combustion gas from the compressed air and fuel, and a turbine 6 configured to be rotationally driven by the combustion gas. In the case of the gas turbine 1 for power generation, a generator (not shown) is connected to the turbine 6.

The compressor 2 includes a plurality of stator blades 16 fixed to a compressor casing 10 and a plurality of rotor blades 18 implanted on a rotor 8 so as to be arranged alternately with the stator blades 16.

To the compressor 2, air sucked in from an air inlet 12 is supplied. The air flows through the plurality of stator blades 16 and the plurality of rotor blades 18 to be compressed into compressed air having a high temperature and a high pressure.

The combustor 4 is supplied with fuel and the compressed air produced in the compressor 2. The combustor 4 mixes the fuel and the compressed air and combusts the mixture to produce a combustion gas that serves as a working fluid of the turbine 6. As shown in FIG. 1, a plurality of combustors 4 may be disposed along the circumferential direction around the rotor inside a casing 20.

The turbine 6 has a combustion gas passage 28 formed inside a turbine casing 22 and includes a plurality of stator blades 24 and a plurality of rotor blades 26 disposed in the combustion gas passage 28.

The stator blades 24 are fixed to the turbine casing 22, and a set of the stator blades 24 arranged along the circumferential direction of the rotor 8 forms a stator blade array. Further, the rotor blades 26 are implanted on the rotor 8, and a set of the rotor blades 26 arranged along the circumferential direction of the rotor 8 forms a rotor blade array. The stator blade arrays and the rotor blade arrays are arranged alternately in the axial direction of the rotor 8.

In the turbine 6, as the combustion gas introduced from the combustor 4 into the combustion gas passage 28 passes through the plurality of stator blades 24 and the plurality of rotor blades 26, the rotor 8 is rotationally driven. Thereby, the generator connected to the rotor 8 is driven to generate power. The combustion gas having driven the turbine 6 is discharged outside via an exhaust chamber 30.

In some embodiments, at least one of the rotor blade 26 or the stator blade 24 of the turbine 6 is a turbine blade 40 described below.

In the following, the rotor blade 26 will be described mainly as the turbine blade 40 with reference to drawings, but basically the same description can be applied to the stator blade 24 as the turbine blade 40.

Figure 2:
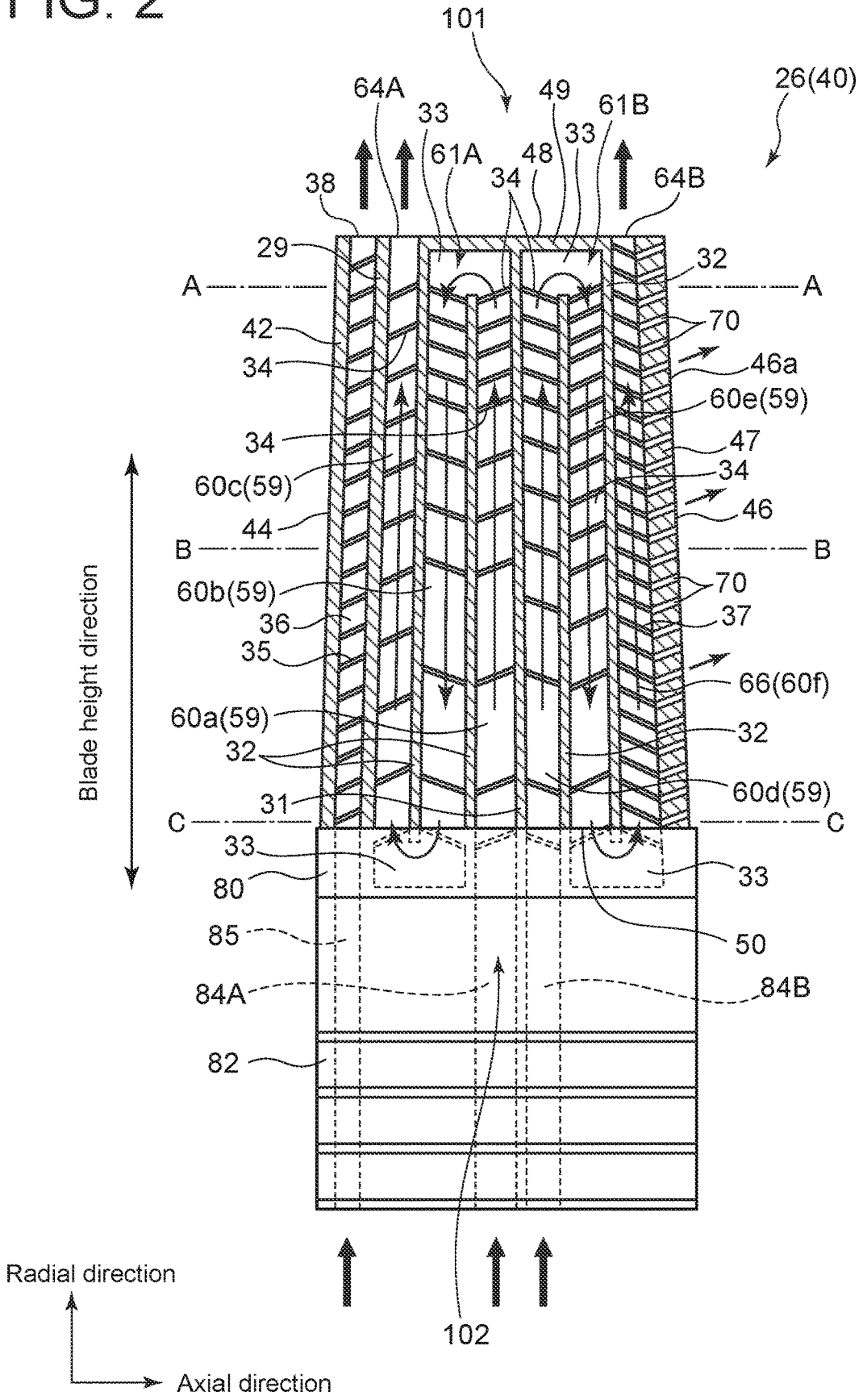
FIG. 2 is a partial cross-sectional view of a rotor blade (turbine blade) according to an embodiment taken along the blade height direction.
Figure 3:
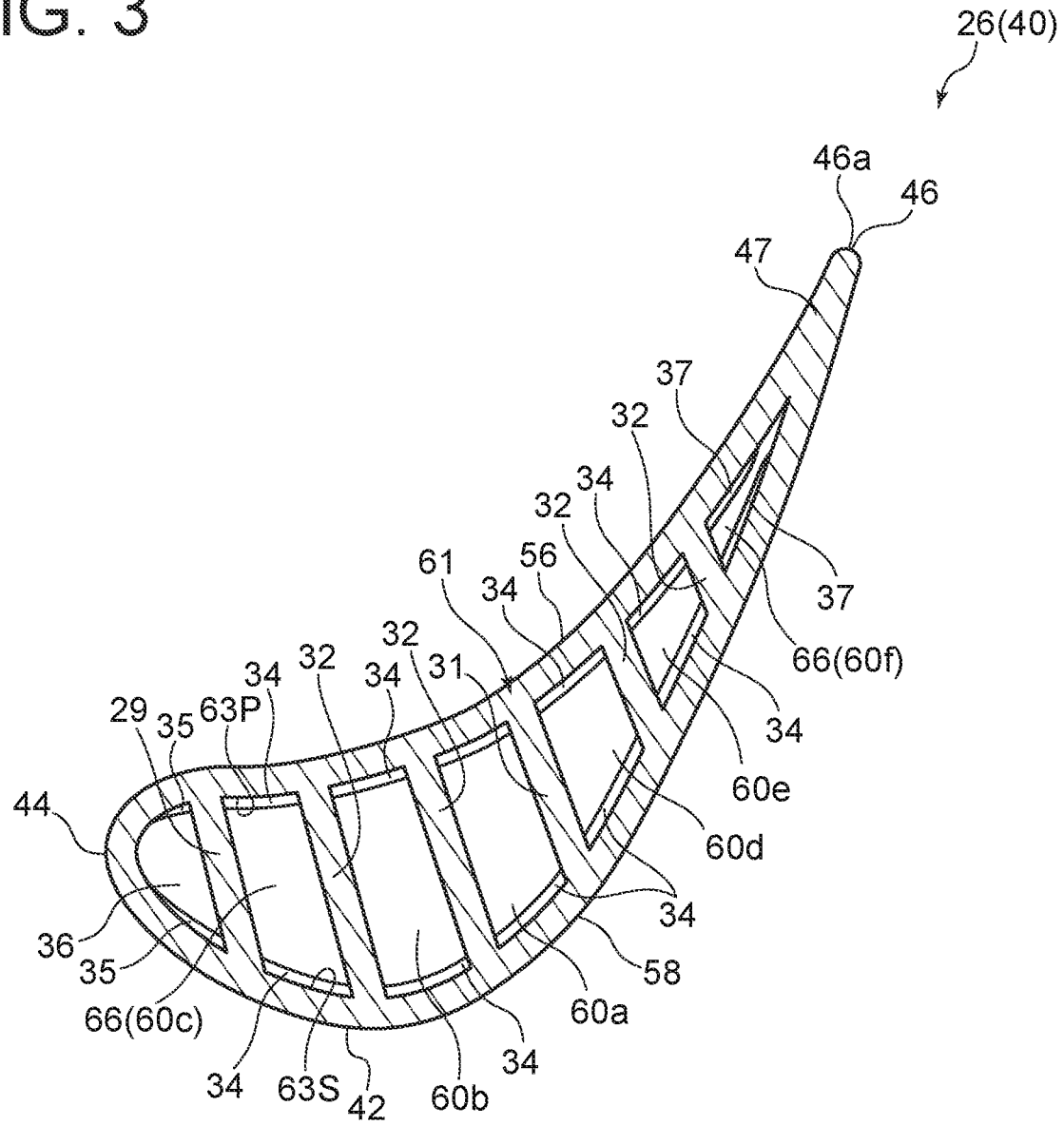
FIG. 3 is a cross-sectional view taken along line B-B in FIG. 2.
Figure 4A:
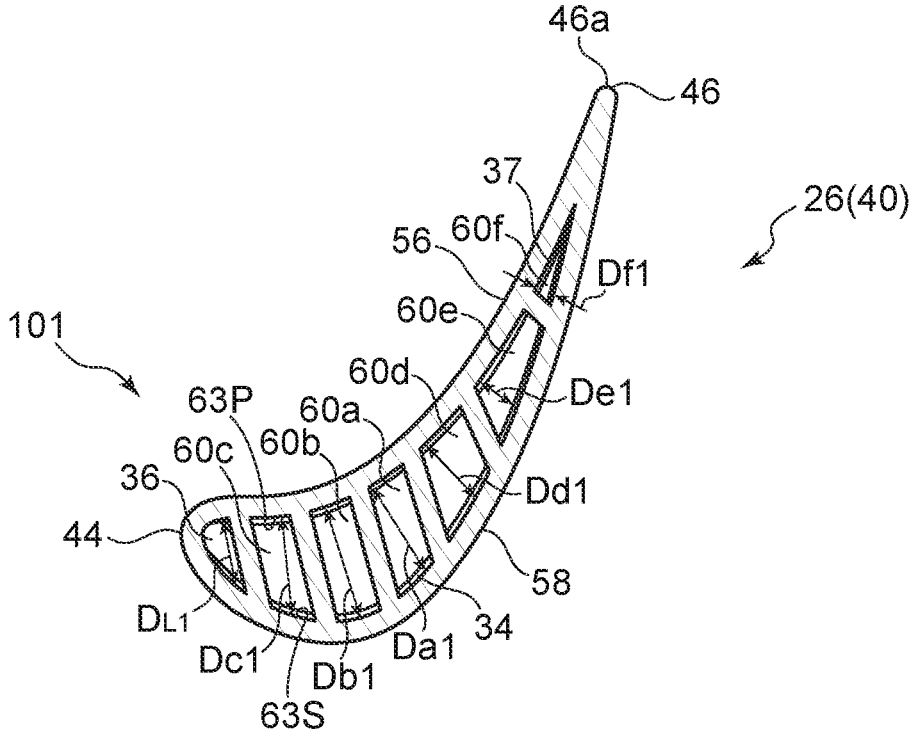
FIG. 4A is a cross-sectional view of the rotor blade taken along line A-A in FIG. 2.
Figure 4B:
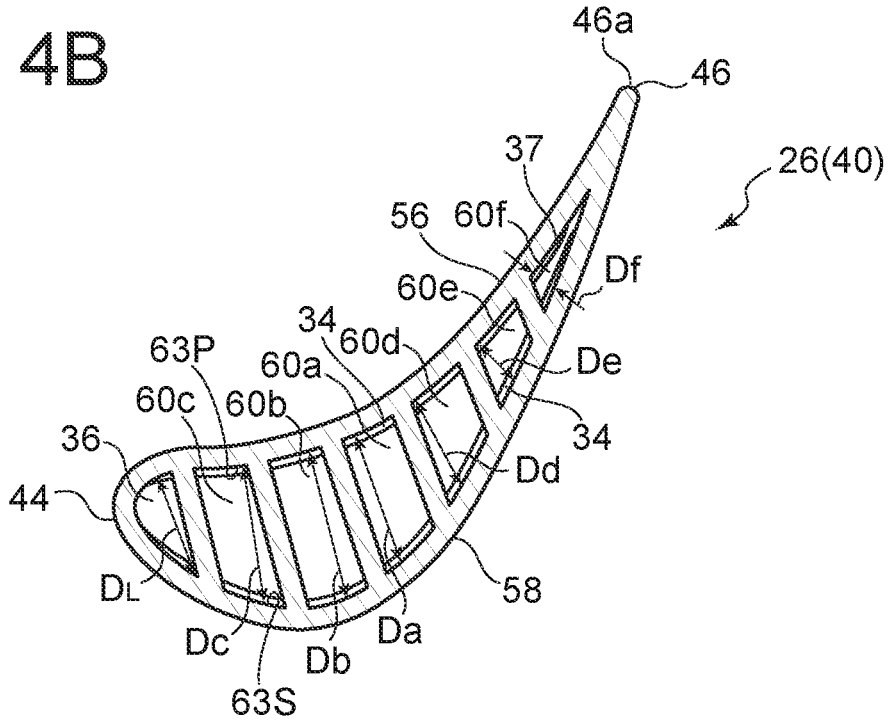
FIG. 4B is a cross-sectional view of the rotor blade taken along line B-B in FIG. 2.
Figure 4C:
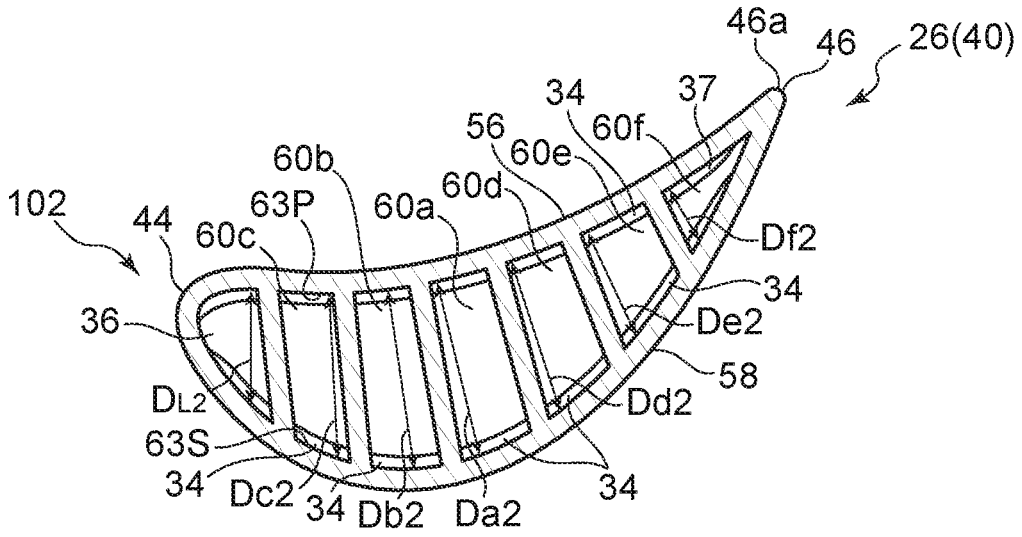
FIG. 4C is a cross-sectional view of the rotor blade taken along line C-C in FIG. 2.

FIG. 2 is a partial cross-sectional view of the rotor blade 26 (turbine blade 40) according to an embodiment taken along the blade height direction. FIG. 3 is a cross-sectional view taken along line B-B in FIG. 2. The arrows in the figure indicate the direction of flow of the cooling fluid. FIGS. 4A to 4C are cross-sectional views of the rotor blade 26 at three different positions in the blade height direction. FIG. 4A shows a cross-section A-A in the vicinity of a tip end 48 in FIG. 2. FIG. 4B shows a cross-section B-B in the vicinity of a middle region in the blade height direction in FIG. 2 (i.e., the figure is equivalent to FIG. 3). FIG. 4C shows a cross-section C-C in the vicinity of a base end 50 of FIG. 2.

As shown in FIGS. 2 and 3, the rotor blade 26 as the turbine blade 40 according to an embodiment includes an airfoil body 42, a platform 80, and a blade root portion 82. The blade root portion 82 is implanted on the rotor 8 (see FIG. 1), so that the rotor blade 26 rotates together with the rotor 8. The platform 80 and the blade root portion 82 are integrally formed.

The airfoil body 42 is disposed so as to extend along the radial direction of the rotor 8 (also simply referred to as "radial direction" or spanwise direction"), and has a base end 50 to which the platform 80 is fixed, and a tip end 48 positioned on the opposite side (radially outer side) from the base end 50 in the blade height direction (radial direction of the rotor 8) and composed of a top plate 49 that forms a top portion of the airfoil body 42.

Further, the airfoil body 42 of the rotor blade 26 has a leading edge 44 and a trailing edge 46 from the base end 50 to the tip end 48. The blade surface of the airfoil body 42 includes a pressure surface 56 formed in a concave shape and a suction surface 58 formed in a convex shape extending along the blade height direction between the base end 50 and the tip end 48.

The airfoil body 42 has a cooling passage through which a cooling fluid (e.g., air) flows to cool the turbine blade 40. In the exemplary embodiment shown in FIGS. 2 and 3, the airfoil body 42 has, as the cooling passage, two serpentine passages (meandering passages) 61A, 61B and a leading-edge-side passage 36 closer to the leading edge 44 than the serpentine passages 61A, 61B. The serpentine passages 61A, 61B and the leading-edge-side passage 36 are supplied with the cooling fluid from the outside via internal passages 84A, 84B, 85, respectively.

Thus, by supplying the cooling fluid to the cooling passage such as the serpentine passages 61A, 61B and the leading-edge-side passage 36, the airfoil body 42 disposed in the combustion gas passage 28 of the turbine 6 and thus exposed to high-temperature combustion gas is convectively cooled from the inner wall surface side.

The two serpentine passages include a serpentine passage 61A positioned on the leading edge 44 side and a serpentine passage 61B positioned on the trailing edge 46 side. These serpentine passages 61A and 61B are separated by a rib (partition wall) 31 disposed inside the airfoil body 42 and extending along the blade height direction.

Further, the serpentine passage 61A and the leading-edge-side passage 36 are separated by a rib 29 disposed inside the airfoil body 42 and extending along the blade height direction.

Each of the serpentine passages 61A, 61B has a plurality of passes 60 (passes 60*a* to 60*c*, 60*d* to 60*f*).

Adjacent passes 60 in each serpentine passage 61A, 61B are separated by a rib 32 disposed inside the airfoil body 42 and extending along the blade height direction.

Further, the adjacent passes 60 in each serpentine passage 61A, 61B are connected to each other at a side of the tip end 48 or the base end 50. At this connection portion, a return passage 33 is formed at which the cooling fluid flow turns opposite with respect to the blade height direction. Thus, the serpentine passages 61A, 61B have a shape meandering in the radial direction as a whole. In other words, each of the plurality of passes 60*a* to 60*c* and the plurality of passes 60*d* to 60*f* is communicated through the return passages 33 to form the serpentine passages 61, 61B, respectively.

In the exemplary embodiment shown in FIGS. 2 and 3, the leading-edge-side serpentine passage 61A includes three passes 60*a* to 60*c*, and the passes 60*a* to 60*c* are arranged from the trailing edge 46 side to the leading edge 44 side in this order. Further, the trailing-edge-side serpentine passage 61B includes three passes 60*d* to 60*f*, and the passes 60*d* to 60*f* are arranged from the leading edge 44 side to the trailing edge 46 side in this order.

The plurality of passes 60 forming the serpentine passage 61A, 61B includes a last pass 66 most downstream in the cooling fluid flow. More specifically, in the serpentine passage 61A, the pass 60*c* closest to the leading edge 44 is the last pass 66, and in the serpentine passage 61B, the pass 60*f* closest to the trailing edge 46 is the last pass 66.

In the turbine blade 40 having the serpentine passages 61A, 61B, the cooling fluid is introduced into the most upstream pass of each serpentine passage 61A, 61B (in the example shown in FIGS. 2 and 3, pass 60*a* and pass 60*d*) for example via the internal passage 84A, 84B formed inside the blade root portion 82, and the cooling fluid flows downstream through the plurality of passes 60 forming each serpentine passage 61A, 61B sequentially. Further, the cooling fluid flowing through the last pass 66 on the most downstream side in the cooling fluid flow direction among the plurality of passes 60 is discharged through an outlet opening 64A, 64B disposed on the tip end 48 side of the airfoil body 42 to the combustion gas passage 28 outside the turbine blade 40. The outlet opening 64A, 64B is an opening formed in the top plate 49. At least a part of the cooling fluid flowing through the last pass 66 is discharged from the outlet opening 64B. When the outlet opening 64B is disposed in the last pass 66 on the trailing edge 46 side, it is possible to suppress overheating of the inner wall surface of the top plate 49 due to stagnation of the cooling fluid in a space in the vicinity of the top plate 49.

The shape of the serpentine passage 61A, 61B is not limited to the shape shown in FIGS. 2 and 3. For instance, the number of serpentine passages formed inside the airfoil body 42 of one turbine blade 40 is not limited to two, but may be one or three of more. Alternatively, the serpentine passage may branch at a branch point on the serpentine passage into a plurality of passages. In any case, the pass closest to the trailing edge among the passes constituting the serpentine passage is the last pass of the serpentine passage.

The leading-edge-side passage 36 is a cooling passage 59 disposed closest to the leading edge 44 and is exposed to the highest heat load. The leading-edge-side passage 36 communicates at the base end 50 side with the internal passage 85 and communicates at the tip end 48 side with the outlet opening 38 formed in the top plate 49. The cooling fluid supplied to the leading-edge-side passage 36 via the internal passage 85 flows through the leading-edge-side passage 36 which is a unidirectional passage from the base end 50 side to the tip end 48 side, and is discharged from the outlet opening 38 to the combustion gas passage 28. The cooling fluid convectively cools the inner wall surface of the leading-edge-side passage 36 in the course of flowing through the leading-edge-side passage 36.

In some embodiments, as shown in FIG. 2, a trailing edge portion 47 (portion including trailing edge 46) of the airfoil body 42 has a plurality of cooling holes 70 arranged along the blade height direction. The plurality of cooling holes 70 communicates with the cooling passage formed inside the airfoil body 42 (in the illustrated example, last pass 66 of serpentine passage 61B on the trailing edge side, i.e., pass 60*f*) and opens to a trailing edge end surface 46*a* which is a surface of the trailing edge portion 47 of the airfoil body 42. In FIG. 3, the cooling holes 70 are not depicted.

A part of the cooling fluid flowing through the cooling passage passes through the cooling hole 70 communicating with the cooling passage and is discharged from the opening of the trailing edge end surface 46*a* of the trailing edge portion 47 of the airfoil body 42 to the combustion gas passage 28 outside the turbine blade 40. Thus, as the cooling fluid passes through the cooling hole 70, the trailing edge portion 47 of the airfoil body 42 is convectively cooled.

The airfoil body 42 of the rotor blade 26 has a first end portion 101 and a second end portion 102 which are opposite end portions in the blade height direction. The first end portion 101 is an end portion on the tip end 48 side of the airfoil body 42, and the second end portion 102 is an end portion on the base end 50 side of the airfoil body 42. In other words, in the rotor blade 26, the first end portion 101 is positioned on the radially outer side of the second end portion 102.

As shown in FIGS. 4A to 4C, the blade width in the suction-pressure direction (i.e. direction connecting suction surface 58 and pressure surface 56) of the airfoil body 42 is greater at the second end portion 102 side (base end 50 side) than at the first end portion 101 side (tip end 48 side). In other words, in the airfoil body 42, the second end portion 102 has a greater blade width in the suction-pressure direction than the first end portion.

Further, as shown in FIGS. 4A to 4C, in the rotor blade 26, the passage width D2 (DL2, Da2, Db2, . . . , etc., in FIG. 4C; hereinafter, also collectively referred to as "D2") of the leading-edge-side passage 36 and each pass 60 of the serpentine passage 61A, 61B at the second end portion 102 (i.e., base end 50 side) is greater than the passage width D1 (DL1, Da1, Db1, . . . , etc., in FIG. 4C; hereinafter, also collectively referred to as "D1") at the first end portion 101 (i.e., tip end 50 side).

Here, the passage width D (DL, Da, Db, . . . , etc.; hereinafter, also collectively referred to as "D") of the cooling passage in the suction-pressure direction of the airfoil body 42 is defined as a maximum value of the distance between an inner wall surface 63P (see FIG. 4B) on the pressure surface 56 side and an inner wall surface 63S (see FIG. 4B) on the suction surface 58 side of the airfoil body 42 as measured from the inner wall surface 63P in each passage (each pass 60 and leading-edge-side passage 36).

The passage width D of the cooling passage may be represented by equivalent diameter ED shown by the following expression (I), considering the case where the cooling passage does not have a rectangular cross-section, but has a deformed shape such as a rhombic cross-section, a trapezoidal cross-section, or a triangular cross-section. The equivalent diameter ED corresponds to the passage width D.

$$ED=4A/L \quad (I)$$

In the expression (I), ED represents equivalent diameter, A represents flow-passage cross-sectional area, and L represents wetted perimeter of the passage cross-section (length of the entire perimeter of one passage cross-section). Therefore, in the following description, the passage width D may be read as the equivalent diameter ED.

For instance, when focusing on the pass 60*b*, which is the third pass counted from the leading edge 44 side among the passages (passes 60 of serpentine passages 61A, 61B, and leading-edge-side passage 36) disposed in the airfoil body 42, the passage width Db1 on the first end portion 101 side (tip end 48 side) and the passage width Db2 on the second end portion 102 side (base end 50 side) satisfy a relationship of Db1<Db2. The same relationship is established in the other passages.

The passage width D may gradually increase from the first end portion 101 side to the second end portion 102 side in the blade height direction.

Further, the flow-passage cross-sectional area of each pass 60 may increase from the first end portion to the second end portion in the blade height direction.

The inner wall surface 63 (inner wall surface 63P on the pressure surface 56 side and/or inner wall surface 63S on the suction surface 58 side) of at least some of the plurality of passes 60 constituting the serpentine passage 61A, 61B has a rib-like turbulator 34. In the exemplary embodiment shown in FIGS. 2 to 4C, the inner wall surface 63P on the pressure surface 56 side and the inner wall surface 63S on the suction surface 58 side of each of the plurality of passes 60 have a plurality of turbulators 34 arranged along the blade height direction.

Further, in some embodiments, as shown in FIGS. 2 to 4C, the inner wall surface of the leading-edge-side passage 36 also has a plurality of turbulators 35 (leading-edge-side turbulators 35) arranged along the blade height direction.

Figure 5:
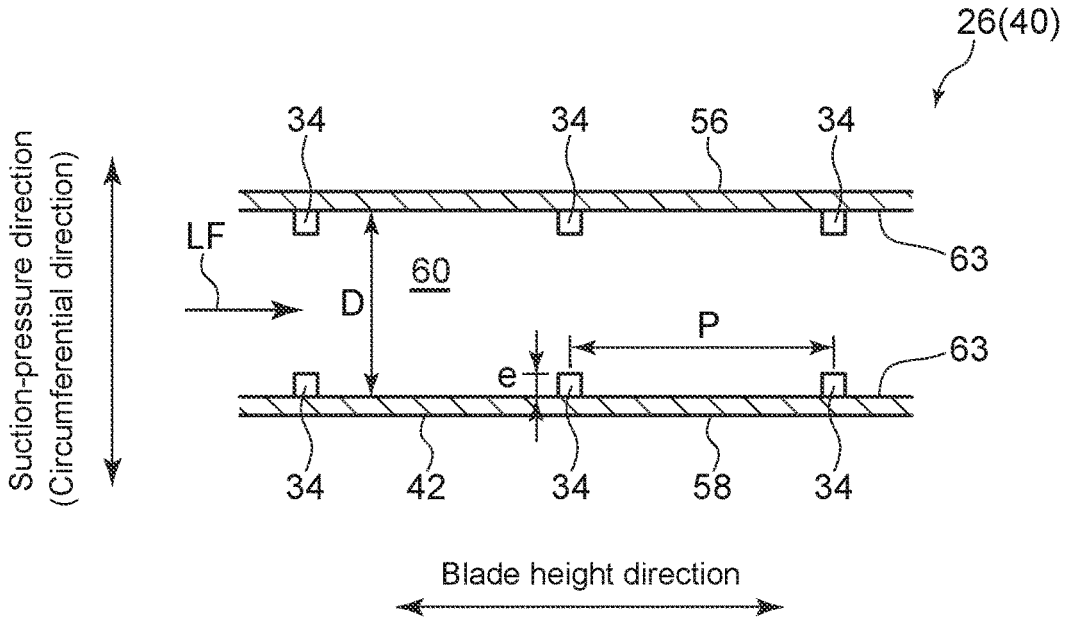
FIG. 5 is a schematic diagram for describing a configuration of a turbulator according to an embodiment.
Figure 6:
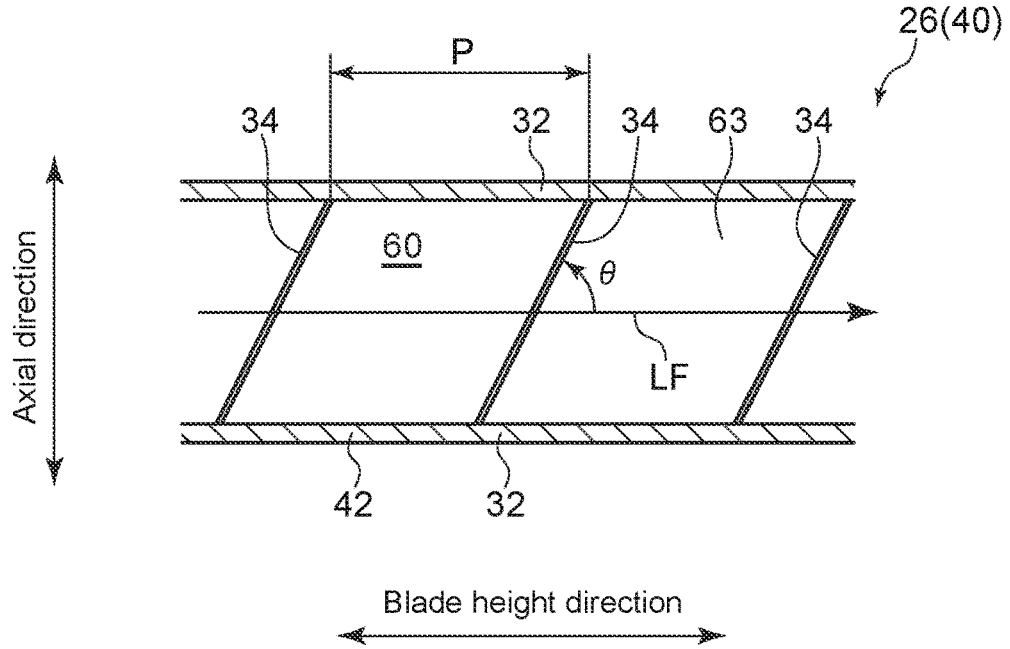
FIG. 6 is a schematic diagram for describing a configuration of a turbulator according to an embodiment.

FIGS. 5 and 6 are schematic diagrams for describing a configuration of the turbulator 34 according to an embodiment. FIG. 5 is a schematic partial cross-sectional view along a plane including the suction-pressure direction (substantially equal to circumferential direction of rotor 8) and the blade height direction (radial direction of rotor 8) of the turbine blade 40 shown in FIGS. 2 to 4C. FIG. 6 is a schematic partial cross-sectional view along a plane including the axial direction of the rotor 8 and the blade height direction (radial direction of rotor 8) of the turbine blade 40 shown in FIGS. 2 to 4C.

As shown in FIG. 5, each turbulator 34 is disposed on the inner wall surface 63 of the pass 60. "e" is the height of the turbulator 34 from the inner wall surface 63. Further, as shown in FIGS. 5 and 6, in the pass 60, the turbulators 34 are arranged at pitch P. Further, as shown in FIG. 6, θ is the angle between the flow direction (arrow LF in FIG. 6) of the cooling fluid in the pass 60 and each turbulator 34 (acute angle; hereinafter referred to as "inclination angle").

The turbulator 34 in the pass 60 promotes turbulence of the flow, for example the occurrence of swirl in the vicinity of the turbulator 34, when the cooling fluid flows through the pass 60. More specifically, the cooling fluid having passed through the turbulator 34 forms swirl with its adjacent turbulator 34 disposed on the downstream side. As a result, in the vicinity of a middle position between the turbulators 34 adjacent to each other in the cooling fluid flow direction, the swirl flow forming turbulence of the cooling fluid comes into contact with the inner wall surface 63 of the pass 60, so that the heat transfer rate between the cooling fluid and the airfoil body 42 is increased. Accordingly, it is possible to effectively cool the turbine blade 40.

That is, since the heat load applied to the turbine blade increases with an increase in output power of the gas turbine, it is desired to downsize the first end portion 101 on the tip end 48 side while increasing the blade width in the suction-pressure direction at the second end portion 102 on the base end 50 side which supports the turbine blade. In this case, since an airfoil with a small blade width on the first end portion 101 side and a great blade width on the second end portion 102 is selected, the cooling passage disposed inside the airfoil body is such that the flow-passage cross-sectional area of the cooling passage on the first end portion 101 side is small while the flow-passage cross-sectional area of the cooling passage on the second end portion 102 side is great. The turbulator 34 is a turbulence promoting member for improving heat transfer on the inner wall surface of the cooling passage, and it is important to select an appropriate height e, pitch P, and inclination angle θ of the turbulator in response to a change in the flow-passage cross-sectional area of the cooling passage in order to achieve maximum cooling performance.

The effect of improving the heat transfer rate by the turbulator 34 varies with the height e, pitch P, inclination angle θ of the turbulator 34 and the passage width D of the pass (passage).

For instance, the occurrence state of swirl flow of the cooling fluid varies with the inclination angle θ of the turbulator 34, which affects the heat transfer rate between the cooling fluid and the blade inner wall. Further, when the height e of the turbulators is too high relative to the pitch P of the turbulators 34, the swirl flow may not contact the inner wall surface 63. Therefore, there are appropriate ranges between the heat transfer rate and the inclination angle θ of the turbulator 34, and between the heat transfer rate and the ratio (P/e) of the pitch P to the height e, as described later. Further, when the height e of the turbulators 34 is too high relative to the passage width D, pressure loss of the cooling fluid increases. On the other hand, when the passage width D of the pass (passage) in the suction-pressure direction is too wide relative to the height e of the turbulators 34, the effect of increasing the heat transfer rate by the swirl flow cannot be expected, and the heat transfer rate is decreased, which may cause a reduction in cooling performance. That is, there are appropriate height e, pitch P, and inclination angle θ of the turbulator 34 which provide high heat transfer rate depending on the shape of the cooling passage.

The effect of improving the heat transfer rate by the turbulator 35 (leading-edge-side turbulator 35) disposed on the leading-edge-side passage 36 also varies with the inclination angle, pitch, and height of the turbulator 35 and the passage width of the leading-edge-side passage 36 in the suction-pressure direction, as with the turbulator 34 described above.

Hereinafter, the features of the turbine blade 40 according to some embodiments, including features of the turbulator 34, will be described with reference to FIGS. 2 to 4C and FIGS. 7 to 9. Before describing them, the configuration of the stator blade 24 (turbine blade 40) according to an embodiment will be described with reference to FIG. 9.

Figure 7:
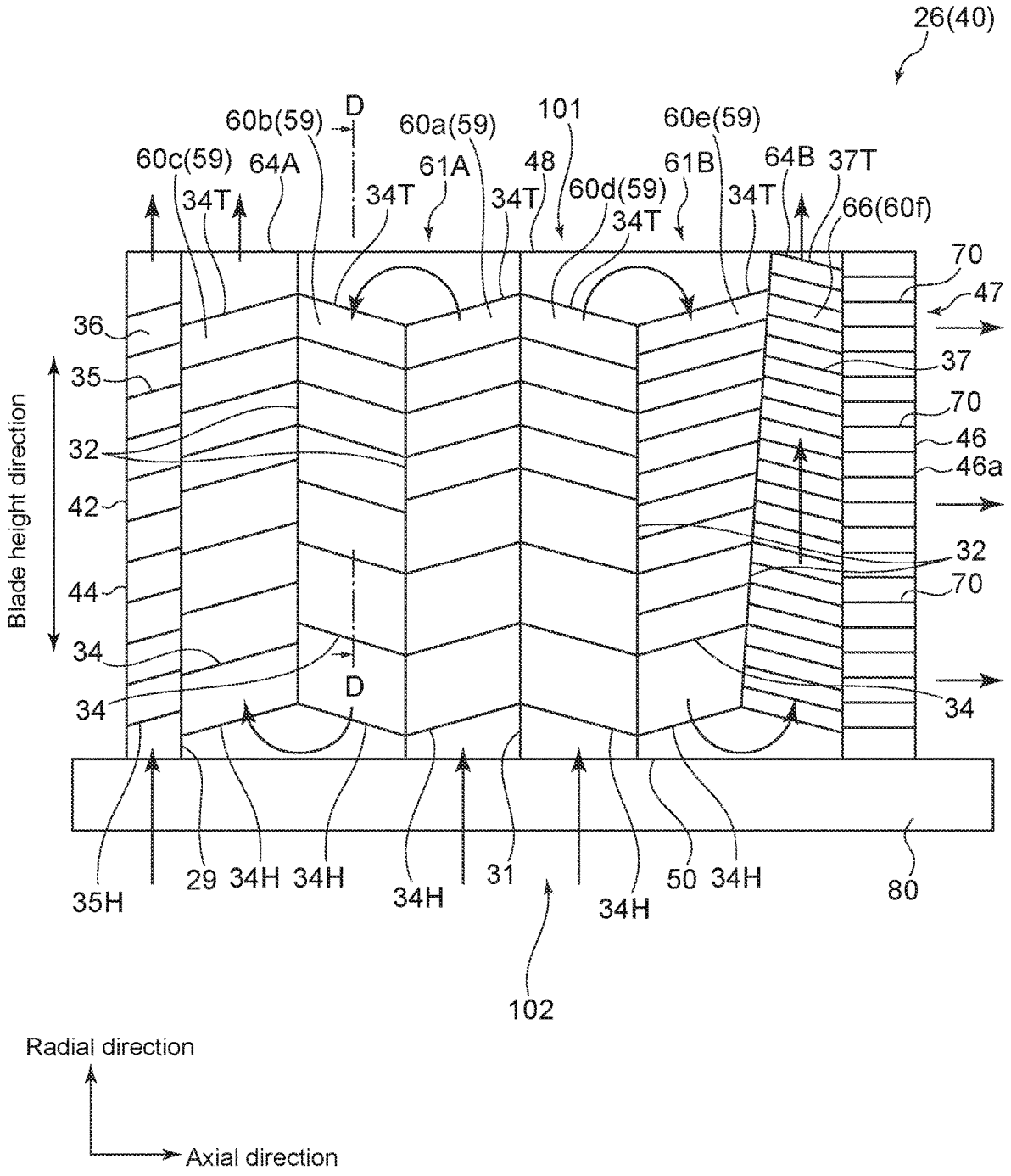
FIG. 7 is a schematic cross-sectional view of the rotor blade (turbine blade) shown in FIGS. 2 to 4C.
Figure 8:
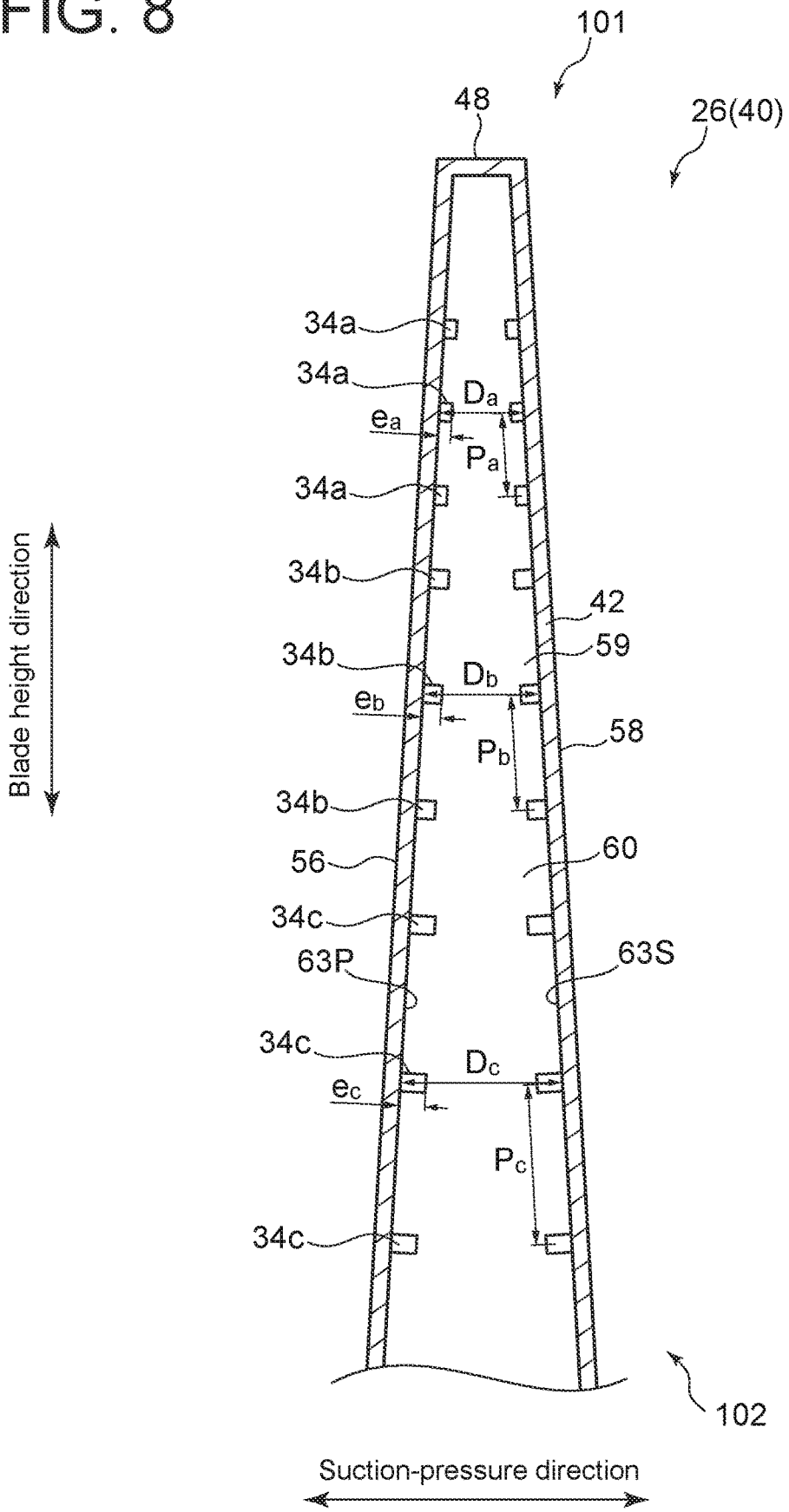
FIG. 8 is a schematic cross-sectional view taken along line D-D in FIG. 7.
Figure 9:
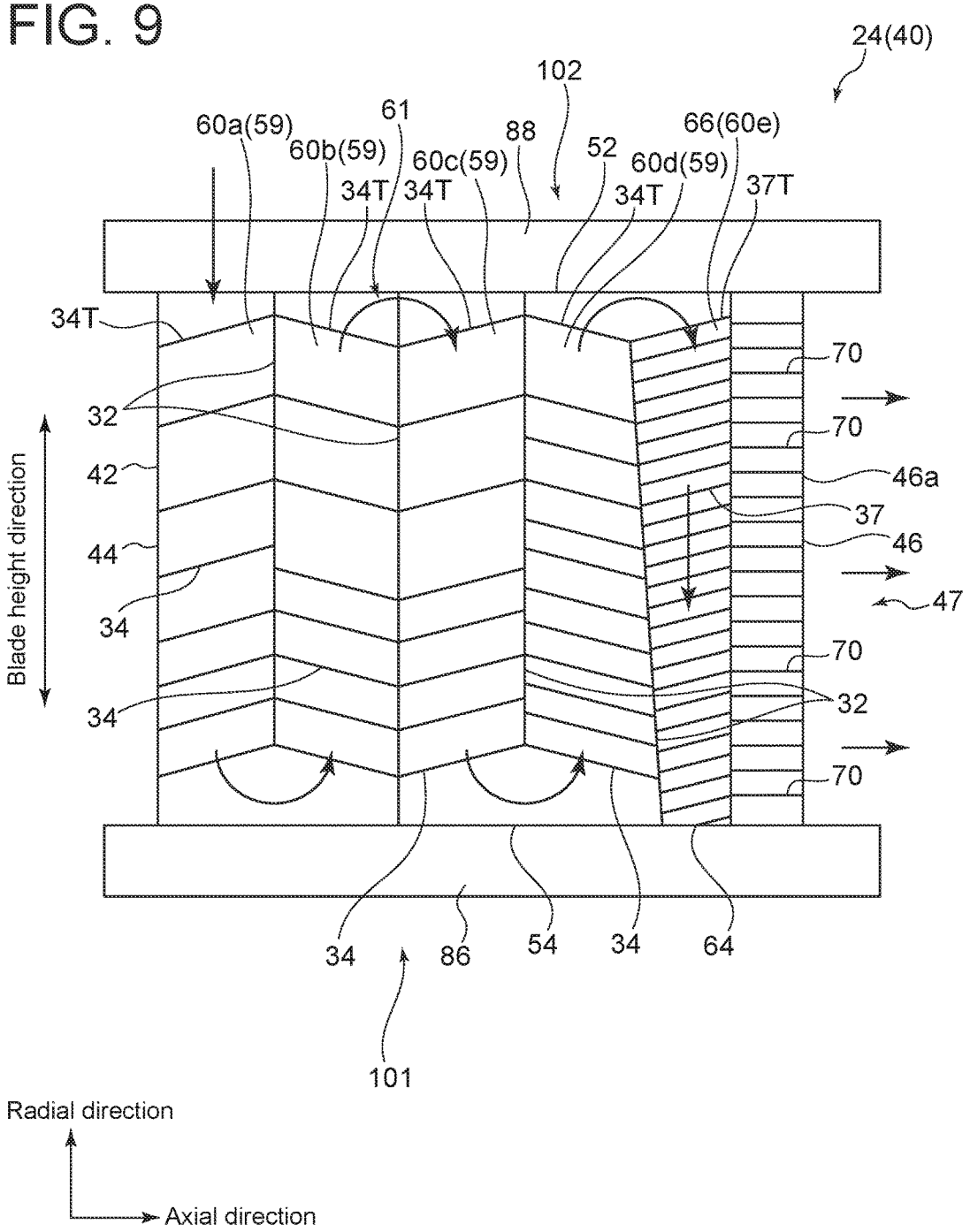
FIG. 9 is a schematic cross-sectional view of a stator blade (turbine blade) according to an embodiment.

FIG. 7 is a schematic cross-sectional view of the rotor blade 26 (turbine blade 40) shown in FIGS. 2 to 4C. FIG. 8 is a schematic cross-sectional view taken along line D-D in FIG. 7. FIG. 9 is a schematic cross-sectional view of the stator blade 24 (turbine blade 40) according to an embodiment. The arrows in the figures indicate the direction of flow of the cooling fluid LF.

As shown in FIG. 9, the stator blade 24 (turbine blade 40) according to an embodiment includes an airfoil body 42, an inner shroud 86 positioned on the radially inner side of the airfoil body 42, and an outer shroud 88 positioned on the radially outer side of the airfoil body 42. The outer shroud 88 is supported by the turbine casing 22 (see FIG. 1), and the stator blade 24 is supported by the turbine casing 22 via the outer shroud 88. The airfoil body 42 has an outer end 52 positioned on the outer shroud 88 side (i.e., on the radially outer side), and an inner end 54 positioned on the inner shroud 86 side (i.e., on the radially inner side).

The airfoil body 42 of the stator blade 24 has a leading edge 44 and a trailing edge 46 from the outer end 52 to the inner end 54. The blade surface of the airfoil body 42 includes a pressure surface 56 and a suction surface 58 extending along the blade height direction between the outer end 52 and the inner end 54.

Inside the airfoil body 42 of the stator blade 24, a serpentine passage 61 composed of a plurality of passes 60 is formed. In the exemplary embodiment shown in FIG. 9, the serpentine passage 61 is composed of five passes 60*a* to 60*e*. The passes 60*a* to 60*e* are arranged from the leading edge 44 side to the trailing edge 46 side in this order.

In the stator blade 24 (turbine blade 40) shown in FIG. 9, the cooling fluid is introduced into the serpentine passage 61 via an internal passage (not shown) formed inside the outer shroud 88, and flows downstream sequentially through the plurality of passes 60. Further, the cooling fluid flowing through the last pass 66 (pass 60*e*) on the most downstream side in the cooling fluid flow direction among the plurality of passes 60 is discharged through an outlet opening 64 disposed on the inner end 54 side (inner shroud 86 side) of the airfoil body 42 to a combustion gas passage 28 outside the stator blade 24 (turbine blade 40), or is discharged through a cooling hole 70 of a trailing edge portion 47, which will be described later, to the combustion gas.

In the stator blade 24, at least some inner wall surfaces of the plurality of passes 60 have the turbulator 34 described above. In the exemplary embodiment shown in FIG. 9, a plurality of turbulators 34 is disposed on the inner wall surface of each of the plurality of passes 60.

In the stator blade 24, the trailing edge portion 47 of the airfoil body 42 may have a plurality of cooling holes 70 arranged along the blade height direction.

The airfoil body 42 of the stator blade 24 has a first end portion 101 and a second end portion 102 which are opposite end portions in the blade height direction. The first end portion 101 is an end portion on the inner end 54 side of the airfoil body 42, and the second end portion 102 is an end portion on the outer end 52 side of the airfoil body 42. In other words, in the stator blade 24, the first end portion 101 is positioned on the radially inner side of the second end portion 102.

The blade width of the stator blade 24 (turbine blade 40) in the suction-pressure direction of the airfoil body 42 is greater at the outer end 52 side (second end portion 102 side) than at the inner end 54 side (first end portion 101 side). In other words, in the airfoil body 42, the second end portion 102 has a greater blade width than the first end portion 101.

Further, although not particularly depicted, regarding the passage width D of the pass 60, the passage width D2 of each pass 60 of the serpentine passage 61 in the suction-pressure direction of the airfoil body 42 at the second end portion 102 (i.e., outer end 52 side) is greater than the passage width D1 at the first end portion 101 (i.e., inner end 54 side), as with the rotor blade 26.

The passage width D may gradually increase from the first end portion 101 side to the second end portion 102 side in the blade height direction.

Further, the flow-passage cross-sectional area of each pass 60 may increase from the first end portion to the second end portion in the blade height direction. The concept of equivalent diameter ED described above can also be applied to the passage width D of the stator blade 24.

Next, with reference to FIGS. 2 to 4C and FIGS. 7 to 9, specific features of the turbine blade 40 according to some embodiments will be described.

In the turbine blade 40 (rotor blade 26 or stator blade 24) according to some embodiments, the height of the plurality of turbulators 34 disposed in the cooling passage 59 which is at least one of the passes 60*a* to 60*f* increases from the first end portion 101 side (tip end 48 side in rotor blade 26, inner end 54 side in stator blade 24) to the second end portion 102 side (base end 50 side in rotor blade 26, outer end 52 side in stator blade 24) in the blade height direction. That is, the height e of the turbulators 34 increases as the passage width D of the cooling passage 59 increases from the first end portion 101 side to the second end portion 102 side in the blade height direction. Otherwise, the height e of the turbulators 34 (height from inner wall surface 63 of cooling passage 59) increases as the flow-passage cross-sectional area of the cooling passage 59 increases from the first end portion 101 side to the second end portion 102 side in the blade height direction.

The height of the plurality of turbulators 34 may gradually change for each turbulator 34 in the blade height direction. More specifically, the height e of each of the plurality of turbulators 34 disposed in the cooling passage 59 may be set such that, among two turbulators 34 at different positions in the blade height direction, the height e of the turbulator 34 closer to the second end portion 102 is greater than the height of the other turbulator 34 (i.e., turbulator 34 closer to the first end portion 101).

Alternatively, the height of the plurality of turbulators 34 may change stepwise for each region in the blade height direction. More specifically, the cooling passage 59 may be divided in the blade height direction into a plurality of regions, and the height e of each of the plurality of turbulators 34 may be set such that the turbulators 34 in the same blade-height-directional region has the same height e, and the height e of the turbulators 34 in a blade-height-directional region closer to the second end portion 102 is greater than the height e of the turbulators 34 in a blade-height-directional region closer to the first end portion 101.

An example of the case where the height of the plurality of turbulators 34 changes for each region in the blade height direction will be described with reference to FIG. 8. FIG. 8 is a cross-sectional view of one of cooling passages 59 constituting the serpentine passage 61 (in this example, pass 60*b* of serpentine passage 61A of rotor blade 26).

The cooling passage 59 illustrated in FIG. 8 is divided into three regions in the blade height direction. The plurality of turbulators 34 disposed in the cooling passage 59 includes turbulators 34*a* belonging to a region closest to the first end portion 101 (region on the tip end 48 side), turbulators 34*c* belonging to a region closest to the second end portion 102

(region on the base end 50 side), and turbulators 34*b* belonging to a region therebetween (middle region).

The representative passage width Da of the cooling passage 59 in the suction-pressure direction at a position of the turbulator 34*a* belonging to the region on the tip end 48 side, the representative passage width Db of the cooling passage 59 in the suction-pressure direction at a position of the turbulator 34*b* belonging to the middle region, and the representative passage width Dc of the cooling passage 59 in the suction-pressure direction at a position of the turbulator 34*c* belonging to the region on the base end 50 side satisfy a relationship of Da<Db>Dc.

The representative passage width D of the cooling passage 59 in the suction-pressure direction in each region may be an average value of the passage widths D of the cooling passage 59 at respective positions in the blade height direction of the turbulators 34 belonging to the region.

The turbulators 34*a*, 34*b*, 34*c* belonging to the same region in the blade height direction have the same height. The height ea of the turbulators 34*a* belonging to the region on the tip end 48 side, the height eb of the turbulators 34*b* belonging to the middle region, and the height ec of the turbulators 34*c* belonging to the region on the base end 50 side satisfy a relationship of ea<eb<ec.

In this way, the height e of the plurality of turbulators 34 disposed in the cooling passage 59 may change stepwise for each region in the blade height direction.

In the turbine blade 40 (rotor blade 26) shown in FIG. 7 and the turbine blade 40 (stator blade 24) shown in FIG. 9, in the cooling passage 59 other than the last pass 66 (pass 60*f* in FIG. 7 and pass 60*e* in FIG. 9) among the passes 60*a* to 60*f* constituting the serpentine passage 61, the plurality of turbulators 34 changes stepwise for each region in the blade height direction, as with the example shown in FIG. 8.

In the example shown in FIG. 8, the cooling passage 59 is divided into three regions in the blade height direction, and the height of the turbulators 34 changes in three stages. However, in other examples (in the other cooling passage 59), the cooling passage 59 may be divided into n regions in the blade height direction, and the height of the turbulators 34 may change in n steps (where n is an integer of 2 or more).

The passes 60*a* to 60*e* (cooling passages) in the rotor blade 26 shown in FIG. 7 and the passes 60*a* to 60*d* (cooling passages) in the stator blade 24 shown in FIG. 9 are each divided into n regions in the blade height direction (where n is 2 or more and 5 or less), and the height of the turbulators 34 changes in n steps in the blade height direction.

When the turbulators 34 are disposed on the inner wall surface 63 of the cooling passage 59, the heat transfer rate between the cooling fluid and the turbine blade 40 is improved as compared with the case where the inner wall surface 63 is a smooth surface without the turbulators 34. However, in the case where the passage width D of the cooling passage 59 varies with position in the blade height direction, if the height e of the turbulator 34 is constant and the same, the effect of improving the heat transfer rate is reduced at a position in the blade height direction where the passage width D of the cooling passage 59 is relatively wide, compared with a position in the blade height direction where the passage width D of the cooling passage 59 is relatively narrow. The reason is that when the height of the turbulator 34 is small relative to the passage width D of the cooling passage 59, it is difficult to effectively produce the swirl flow that forms turbulence in the cooling fluid flowing through the cooling passage 59 having a relatively wide width.

In this regard, in the above-described embodiment, it is desirable to select the height e of the turbulators 34 so as to maintain the heat transfer rate on the blade surface even when the passage width D of the cooling passage 59 varies along the blade height direction. The height of the turbulators 34 is set to increase from the first end portion 101 with a relatively small passage width D of the cooling passage 59 to the second end portion 102 with a relatively great passage width D of the cooling passage 59 so as to maintain the heat transfer rate on the blade surface. As a result, the swirl flow can be effectively produced by the turbulator 34 even on the second end portion 102 side, so that the effect of improving the heat transfer rate by the turbulator 34 can be obtained as much as on the first end portion 101 side.

On the other hand, it is not desirable to increase the turbulator height e on the first end portion 101 side having a small passage width D, as compared with the second end portion 102 having a great passage width D, to be greater than an appropriate height, in view of an increase in pressure loss of the cooling fluid. In the above-described embodiment, the height e of the turbulators 34 is set to decrease with a decrease in the passage width D of the cooling passage 59 on the first end portion 101 side in the blade height direction. Thus, in view of pressure loss of the cooling fluid flowing through the cooling passage, it is possible to suppress an increase in pressure loss due to the presence of the turbulator 34 on the first end portion 101 side where the pressure loss tends to increase due to a relatively narrow passage width D of the cooling passage 59.

Therefore, according to the above-described embodiment, it is possible to efficiently cool the turbine blade 40 having a passage width D of the cooling passage 59 varying along the blade height direction.

In some embodiments, a relationship of $0.5 \leq (e/D)/(e/D)_{AVE} \leq 2.0$ is satisfied, where (e/D) is a ratio of the height e of any one turbulator 34 of the plurality of turbulators 34 to the passage width D of the cooling passage 59 in the suction-pressure direction at a position of the turbulator 34 in the blade height direction, and $(e/D)_{AVE}$ is an average of the ratio (e/D) of the plurality of turbulators 34 (i.e., all turbulators 34 disposed in the cooling passage 59).

In some embodiments, (e/D) and $(e/D)_{AVE}$ may satisfy $0.9 \leq (e/D)/(e/D)_{AVE} \leq 1.1$.

Alternatively, in some embodiments, (e/D) and $(e/D)_{AVE}$ may satisfy $(D1/D2) \leq (e/D)/(e/D)_{AVE} \leq (D2/D1)$. In this expression, D1 is the passage width of the cooling passage 59 at a position of the turbulator 34 closest to the first end portion 101 in the blade height direction among the plurality of turbulators 34. D2 is the passage width of the cooling passage 59 at a position of the turbulator 34 closest to the second end portion 102 in the blade height direction among the plurality of turbulators 34.

The relationship of the above relational expression may be established for each (all) of the plurality of turbulators 34 disposed in the cooling passage 59.

In the above-described embodiment, (e/D) regarding any turbulator 34 of the plurality of turbulators 34 disposed in the cooling passage 59 is set to a value close to $(e/D)_{AVE}$ which is an average of (e/D) of all turbulators disposed in the cooling passage. Otherwise, the change in (e/D) is set to be smaller than the change in passage width D of the cooling passage, from the first end portion 101 to the second end portion 102 in the blade height direction. Accordingly, it is possible to suppress an excessive reduction in heat transfer rate and an excessive increase in pressure loss along the blade height direction. Thus, it is possible to effectively cool the turbine blade 40 while suppressing uneven distribution of the metal temperature of the blade wall.

In some embodiments, a relationship of $1.5 \leq (D2/D1)$ is satisfied, where D1 is the passage width of the cooling passage 59 (at least one of passes 60*a* to 60*f*) at a position of a turbulator 34 closest to the first end portion 101 in the blade height direction among the plurality of turbulators 34 disposed in the cooling passage 59, D2 is the passage width of the cooling passage 59 at a position of a turbulator 34 closest to the second end portion 102 in the blade height direction among the plurality of turbulators 34 disposed in the cooling passage 59, and (D2/D1) is a ratio of the passage width D2 to the passage width D1.

Further, the passage width D1 and the passage width D2 may satisfy a relationship of $2.0 \leq (D2/D1)$.

Further, the passage width D1 and the passage width D2 may satisfy a relationship of $2.5 \leq (D2/D1)$.

In the above-described embodiment, in the turbine blade 40 in which the passage width D2 of the cooling passage 59 on the second end portion 102 side is significantly greater than the passage width D1 of the cooling passage 59 on the first end portion 101 side, the height of the turbulators 34 is increased at a position in the blade height direction on the second end portion 102 side with a great passage width D of the cooling passage 59. Thus, it is possible to efficiently cool the turbine blade 40 having a passage width D of the cooling passage 59 varying along the blade height direction.

In some embodiments, the pitch P in the blade height direction between a pair of turbulators 34 which are adjacent in the blade height direction among the plurality of turbulators 34 disposed in the cooling passage 59 (at least one of passes 60*a* to 60*f*) increases from the first end portion 101 toward the second end portion 102 in the blade height direction.

The effect of improving the heat transfer rate by the turbulator 34 varies with the pitch P between turbulators 34 adjacent in the blade height direction, and there is a ratio (P/e) of the pitch P to the height e of the turbulator 34 which provides high heat transfer rate. In this regard, according to the above-described embodiment, the pitch P between turbulators 34 adjacent in the blade height direction increases from the first end portion 101 toward the second end portion 102 in the blade height direction, i.e., as the height e of the turbulators 34 increases. Thus, it is possible to achieve high heat transfer rate in the entire range from the first end portion 101 to the second end portion 102 in the blade height direction where the turbulators 34 are disposed in the cooling passage 59.

In the above-described embodiment, the pitch P in the blade height direction between a pair of turbulators 34 adjacent in the blade height direction may gradually change for each turbulator 34 in the blade height direction. More specifically, the pitch P of each pair of the plurality of turbulators 34 disposed in the cooling passage 59 may be set such that, among two pairs of turbulators 34 at different positions in the blade height direction, the pitch P of the pair of turbulators 34 closer to the second end portion 102 is greater than the pitch P of the other pair of turbulators 34 (i.e., pair of turbulators 34 closer to the first end portion 101).

Alternatively, the pitch P in the blade height direction between a pair of turbulators 34 adjacent in the blade height direction may change stepwise for each region in the blade height direction. More specifically, the cooling passage 59 may be divided in the blade height direction into a plurality of regions, and the pitch P of each pair of the plurality of turbulators 34 disposed in the cooling passage 59 may be set such that the turbulators 34 in the same blade-height-directional region has the same pitch P, and the pitch P of the turbulators 34 in a blade-height-directional region closer to the second end portion 102 is greater than the pitch P of the turbulators 34 in a blade-height-directional region closer to the first end portion 101.

For instance, the cooling passage 59 illustrated in the FIG. 8 is divided into three regions in the blade height direction as described above, and the plurality of turbulators 34 disposed in the cooling passage 59 includes turbulators 34*a* belonging to a region closest to the first end portion 101 (region on the tip end 48 side), turbulators 34*c* belonging to a region closest to the second end portion 102 (region on the base end 50 side), and turbulators 34*b* belonging to a region therebetween (middle region).

The pitch Pa of the turbulators 34*a* belonging to the region on the tip end 48 side, the pitch Pb of the turbulators 34*b* belonging to the middle region, and the pitch Pc of the turbulators 34*c* belonging to the region on the base end 50 side satisfy a relationship of $Pa<Pb<Pc$.

In this way, the pitch P of the plurality of turbulators 34 disposed in the cooling passage 59 may change stepwise for each region in the blade height direction.

In other words, regarding a certain cooling passage 59, the cooling passage 59 may be divided into n regions in the blade height direction, and the pitch P of the turbulators 34 may change in n steps (where n is an integer of 2 or more).

In some embodiments, a relationship of $0.5 \leq (P/ea)/(P/ea)_{AVE} \leq 2.0$ is satisfied, where (P/ea) is a ratio of the pitch P between a pair of turbulators 34 which are adjacent in the blade height direction among the plurality of turbulators 34 disposed in the cooling passage 59 (at least one of passes 60*a* to 60*f*) to an average height ea of the pair of turbulators 34, and $(P/ea)_{AVE}$ is an average of the ratio (P/ea) of the plurality of turbulators 34.

In some embodiments, (P/ea) and $(P/ea)_{AVE}$ may satisfy a relationship of $0.9 \leq (P/ea)/(P/ea)_{AVE} \leq 1.1$.

In the above-described embodiment, (P/ea) of a pair of turbulators 34 among the plurality of turbulators 34 disposed in the cooling passage 59 is set to a value close to $(P/ea)_{AVE}$ which is an average of (P/ea) of the plurality of turbulators 34 (all turbulators 34) disposed in the cooling passage 59. Thus, the pitch P between the adjacent turbulators 34 tends to increase from the first end portion 101 toward the second end portion 102 in the blade height direction, i.e., as the height e of the turbulators 34 increases. Thus, by appropriately setting (P/ea) or $(P/ea)_{AVE}$, it is possible to achieve high heat transfer rate in the blade-height-directional range where the turbulators 34 are disposed in the cooling passage 59.

In some embodiments, a relationship of $0.5 \leq \theta/\theta_{AVE} \leq 2.0$ is satisfied, where θ is an inclination angle of any of the turbulators 34 with respect to the cooling fluid flow direction in the cooling passage 59 (at least one of passes 60*a* to 60*f*), and $\theta_{AVE}$ is an average of the inclination angle θ of the plurality of turbulators (all turbulators disposed in the cooling passage 59).

The effect of improving the heat transfer rate by the turbulator 34 varies with the inclination angle θ of the turbulator 34 with respect to the cooling fluid flow direction in the cooling passage 59, and there is an inclination angle of the turbulator 34 which provides high heat transfer rate. In this regard, according to the above-described embodiment, since the inclination angle θ of the turbulators 34 is substantially constant in the blade height direction, it is possible to achieve high heat transfer rate in the blade-height-directional range where the turbulators 34 are disposed in the cooling passage 59.

In some embodiments, the cooling passage 59 is at least one pass 60 other than the last pass (pass 60*f* in rotor blade 26 (see FIG. 7), pass 60*e* of stator blade 24 (see FIG. 9)) among the plurality of passes 60*a* to 60*f* constituting the serpentine passage 61. The inner wall surface 63 of the last pass (pass 60*f* in FIG. 7, pass 60*e* in FIG. 9) on the suction side (suction surface 58 side) and the pressure side (pressure surface 56 side) has a plurality of last-pass turbulators 37 arranged along the blade height direction.

Further, when e is the height of the turbulator 34 or the last-pass turbulator 37, and D is the passage width of the cooling passage 59 or the last pass 66 in the suction-pressure direction at a position of the turbulator 34 or the last-pass turbulator 37 in the blade height direction, a relationship of the following expression (II) is established.

$$[(e/D)_{E1}/(e/D)_{AVE}]<[(e/D)_{T_E1}/(e/D)_{T_AVE}] \quad \text{(II)}$$

In the expression (II), $(e/D)_{E1}$ is a ratio of the height to the passage width of a turbulator 34T (see FIG. 7 and FIG. 9) closest to the first end portion 101 in the blade height direction among the plurality of turbulators 34, $(e/D)_{AVE}$ is an average of a ratio (e/D) of the height to the passage width of the plurality of turbulators 34, $(e/D)_{T_E1}$ is a ratio of the height to the blade width of a last-pass turbulator 37T (see FIG. 7 and FIG. 9) closest to the first end portion 101 in the blade height direction among the plurality of last-pass turbulators 37, and $(e/D)_{T_AVE}$ is an average of a ratio $(e/D)_T$ of the height to the blade width of the plurality of last-pass turbulators 37.

As described above, regarding the turbulators 34 disposed in the cooling passage 59 which is the pass 60 other than the last pass 66, since the height e of the turbulators 34 increases from the first end portion 101 side with a relatively narrow passage width D of the cooling passage 59 to the second end portion 102 side with a relatively wide passage width D of the cooling passage 59, the ratio (e/D) of the height e of the turbulator 34 to the passage width D tends to be constant (i.e., the left side of the above relational expression is close to 1). Accordingly, the above relational expression indicates that, in the last pass 66, from the second end portion 102 side to the first end portion 101 side in the blade height direction, the passage width D of the last pass 66 decreases, but the height e of the last-pass turbulators 37 does not decrease as much as the passage width D.

That is, according to the above-described embodiment, the height e of the plurality of last-pass turbulators 37 in the last pass 66 of the serpentine passage 61 does not change so much in the blade height direction compared with the other passes 60. In the last pass 66 in the vicinity of the trailing edge portion 47, the passage width D of the last pass 66 is narrow, so that it is difficult to select the turbulator height e corresponding to the passage width D of the cooling passage 59. In other words, the height e of the last-pass turbulator 37 may become too small depending on the passage width D of the last pass 66 to machine the turbulator. Therefore, there is a case where the last-pass turbulator 37 having a height e larger than an appropriate height e of the turbulator 34 corresponding to the passage width D is selected within a range in which pressure loss of the cooling fluid flowing through the last pass 66 is allowed. Although the height of the last-pass turbulator 37 formed in the last pass 66 is smaller than the height of the turbulator 34 in the other passes 60, the ratio (e/D) of the height e to the passage width D regarding the last-pass turbulator 37 is greater than the ratio (e/D) applied to the other passes 60. Further, as described above, the ratio (P/e) of the pitch P to the height of the last-pass turbulator 37 is selected so as to be constant in the blade height direction. Since the height e of the last-pass turbulator 37 is smaller than that in the other passes 60, the number of the last-pass turbulators 37 arranged in the last pass is larger than that in the other passes. Accordingly, in terms of both the ratio (e/D) of the height e to the passage width D and the ratio (P/e) of the pitch P to the height e, the last pass 66 has a higher heat transfer rate than the other passes 60.

Furthermore, in the last pass 66 where the cooling fluid has a relatively high temperature in the serpentine passage 61, the flow-passage cross-sectional area of the last pass 66 may be decreased from the second end portion 102 toward the first end portion 101 to increase the flow velocity of the cooling fluid compared with the other passes 60. Thus, in the last pass 66, the cooling passage 59 with a higher heat transfer rate than the other passes 60 can be formed by increasing the flow velocity of the cooling fluid flowing through the cooling passage 59 and increasing the ratio (e/D) of the height e to the passage width D of each last-pass turbulator 37 and the installation number of the last-pass turbulators 37. Consequently, it is possible to more effectively cool the turbine blade 40 by the cooling fluid flowing through the last pass 66 exposed to high heat load.

In some embodiments, the height e of the last-pass turbulator 37 disposed in the last pass 66 is less than the height of the turbulator 34 disposed in an upstream cooling passage, which is one of the plurality of passes 60, positioned adjacent to the upstream side of the last pass 66 in the cooling fluid flow direction and communicating with the last pass 66.

For instance, in the embodiment of the rotor blade 26 shown in FIG. 7, the upstream cooling passage positioned adjacent to the upstream side of the last pass 66 (pass 60*f*) in the cooling fluid flow direction and communicating with the last pass 66 is the pass 60*e*. The height of the last-pass turbulator 37 disposed in the last pass 66 (pass 60*f*) is less than the height of the turbulator 34 disposed in the pass 60*e* which is the upstream cooling passage.

Further, for instance, in the embodiment of the stator blade 24 shown in FIG. 9, the upstream cooling passage positioned adjacent to the upstream side of the last pass 66 (pass 60*e*) in the cooling fluid flow direction and communicating with the last pass 66 is the pass 60*d*. The height of the last-pass turbulator 37 disposed in the last pass 66 (pass 60*e*) is less than the height of the turbulator 34 disposed in the pass 60*d* which is the upstream cooling passage.

Further, when comparing the heights e of the turbulators of each pass 60 in the same position in the blade height direction from the base end 50 at the second end portion 102 to the tip end 48 at the first end portion 101, the height e of the last-pass turbulator 37 of the last pass 66 is selected to be less than the height e of the turbulator 34, disposed in the same position as the last-pass turbulator 37 in the blade height direction, of the other pass 60 positioned on the upstream side in the cooling fluid flow direction. As a result, it is possible to suppress the occurrence of excessive pressure loss applied to the cooling fluid flowing through the last pass while maintaining high heat transfer rate of the last-pass turbulator.

According to the above-described embodiment, since the height of the turbulator (last-pass turbulator 37) of the last pass 66 which is closest to the trailing edge in the serpentine passage 61 is less than the height of the turbulator of the upstream cooling passage adjacent to and communicating with the last pass 66, in the last pass 66 where the flow passage area is relatively narrow and the cooling fluid has a relatively high temperature among the plurality of passes 60 constituting the serpentine passage 61, a large number of turbulators (last-pass turbulator 37) can be arranged. Thus, it is possible to more effectively cool the turbine blade 40 by the cooling fluid flowing through the last pass 66.

In some embodiments, when e is the height of the turbulator 34 disposed in the cooling passage 59 or the leading-edge-side turbulator 35 disposed in the leading-edge-side passage 36, and D is the passage width of the cooling passage 59 or the leading-edge-side passage 36 in the suction-pressure direction at a position of the turbulator 34 or the leading-edge-side turbulator 35 in the blade height direction, a relationship of the following expression (III) is established.

$$[(e/D)_{E2}/(e/D)_{AVE}]>[(e/D)_{L_E2}/(e/D)_{L_AVE}] \quad \text{(III)}$$

In the expression (III), $(e/D)_{E2}$ is a ratio of the height to the passage width of a turbulator 34H (see FIG. 7 and FIG. 9) closest to the second end portion 102 in the blade height direction among the plurality of turbulators 34, $(e/D)_{AVE}$ is an average of a ratio (e/D) of the height to the passage width of the plurality of turbulators 34, $(e/D)_{L_E2}$ is a ratio of the height to the blade width of a leading-edge-side turbulator 35H (see FIG. 7 and FIG. 9) closest to the second end portion 102 in the blade height direction among the plurality of leading-edge-side turbulators 35, and $(e/D)_{L_AVE}$ is an average of a ratio $(e/D)_L$ of the height to the blade width of the plurality of leading-edge-side turbulators 35.

As described above, regarding the turbulators 34 disposed in the cooling passage 59, since the height e of the turbulators 34 increases from the first end portion 101 side with a relatively narrow passage width D of the cooling passage 59 to the second end portion 102 side with a relatively wide passage width D of the cooling passage 59, the ratio (e/D) of the height e of the turbulator 34 to the passage width D tends to be constant (i.e., the left side of the above relational expression is close to 1). Accordingly, the above relational expression indicates that, from the first end portion 101 side to the second end portion 102 side in the blade height direction, the passage width D of the last pass 66 increases, but the height e of the leading-edge-side turbulators 35 does not increase as much as the passage width D.

That is, according to the above-described embodiment, the height e of the plurality of leading-edge-side turbulators 35 in the leading-edge-side passage 36 does not change so much in the blade height direction. Accordingly, in the leading-edge-side passage 36 supplied with the cooling fluid having a relatively low temperature, it is possible to suppress the effect of improving the heat transfer rate by the turbulator (leading-edge-side turbulator 35) on the second end portion 102 side upstream in the cooling fluid flow direction, and suppress the temperature increase of the cooling fluid flowing toward the first end portion 101 side. Consequently, it is possible to more effectively cool the turbine blade 40.

Embodiments of the present invention were described in detail above, but the present invention is not limited thereto, and various amendments and modifications may be implemented.

Further, in the present specification, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

REFERENCE SIGNS LIST

1 Gas turbine
2 Compressor
4 Combustor
6 Turbine
8 Rotor
10 Compressor casing
12 Air inlet
16 Stator blade
18 Rotor blade
20 Casing
22 Turbine casing
24 Stator blade
26 Rotor blade
28 Combustion gas passage
29 Rib
30 Exhaust chamber
31 Rib
32 Rib
33 Return passage
34 Turbulator
35 Leading-edge-side turbulator
36 Leading-edge-side passage
38 Outlet opening
37 Last-pass turbulator
40 Turbine blade
42 Airfoil body
44 Leading edge
46 Trailing edge
46*a* Trailing edge end surface
47 Trailing edge portion
48 Tip end
49 Top plate
50 Base end
52 Outer end
54 Inner end
56 Pressure surface
58 Suction surface
59 Cooling passage
60, 60*a* to 60*f* Pass
61, 61A, 61B Serpentine passage
63 Inner wall surface
64 Outlet opening
66 Last pass
70 Cooling hole
80 Platform
82 Blade root portion
84A, 84B Internal passage
85 internal passage
86 Inner shroud
88 Outer shroud
101 First end portion
102 Second end portion
D Passage width P Turbulator pitch
e Turbulator height
θ Inclination angle

The invention claimed is:

1. A turbine blade, comprising:

an airfoil body having a first end portion and a second end portion which are opposite end portions in a blade height direction;

a cooling passage extending along the blade height direction inside the airfoil body; and a plurality of turbulators disposed on an inner wall surface of the cooling passage and arranged along the cooling passage, wherein a passage width of the cooling passage in a suction-pressure direction of the airfoil body at the second end portion is greater than a passage width of the cooling passage at the first end portion, and wherein a height of the plurality of turbulators increases from a first end portion side to a second end portion side in the blade height direction.

2. The turbine blade according to claim 1, wherein a relationship of $0.5 \leq (e/D)/(e/D)_{AVE} \leq 2.0$ is satisfied, where (e/D) is a ratio of a height e of each of the plurality of turbulators to a passage width D of the cooling passage in the suction-pressure direction at a position of the turbulator in the blade height direction, and $(e/D)_{AVE}$ is an average of the ratio (e/D) of the plurality of turbulators.

3. The turbine blade according to claim 1, wherein a relationship of $1.5 \leq (D2/D1)$ is satisfied, where D1 is a passage width of the cooling passage at a position of a turbulator closest to the first end portion in the blade height direction among the plurality of turbulators, D2 is a passage width of the cooling passage at a position of a turbulator closest to the second end portion in the blade height direction among the plurality of turbulators, and (D2/D1) is a ratio of the passage width D2 to the passage width D1.

4. The turbine blade according to claim 1, wherein a pitch in the blade height direction between a pair of turbulators which are adjacent in the blade height direction increases from the first end portion toward the second end portion in the blade height direction.

5. The turbine blade according to claim 1, wherein a relationship of $0.5 \leq (P/ea)/(P/ea)_{AVE} \leq 2.0$ is satisfied, where (P/ea) is a ratio of a pitch P between a pair of turbulators which are adjacent in the blade height direction among the plurality of turbulators to an average height ea of the pair of turbulators, and $(P/ea)_{AVE}$ is an average of the ratio (P/ea) of the plurality of turbulators.

6. The turbine blade according to claim 1, wherein the cooling passage is one of a plurality of passes constituting a serpentine passage formed inside the airfoil body.

7. The turbine blade according to claim 6, wherein the cooling passage is a pass other than a last pass which is closest to a trailing edge among the plurality of passes constituting the serpentine passage, wherein the turbine blade comprises a plurality of last-pass turbulators disposed on suction-side and pressure-side inner wall surfaces of the last pass and arranged along the blade height direction, and wherein, when e is a height of each turbulator or each last-pass turbulator, and D is a passage width of the cooling passage or the last pass in the suction-pressure direction at a position of the turbulator or the last-pass turbulator in the blade height direction, a relationship of $[(e/D)_{E1}/(e/D)_{AVE}] < [(e/D)_{T_E1}/(e/D)_{T_AVE}]$ is satisfied, where $(e/D)_{E1}$ is a ratio of the height to the passage width of a turbulator closest to the first end portion in the blade height direction among the plurality of turbulators, $(e/D)_{AVE}$ is an average of a ratio (e/D) of the height to the passage width of the plurality of turbulators, $(e/D)_{T_E1}$ is a ratio of the height to the blade width of a last-pass turbulator closest to the first end portion in the blade height direction among the plurality of last-pass turbulators, and $(e/D)_{T_AVE}$ is an average of a ratio $(e/D)_T$ of the height to the blade width of the plurality of last-pass turbulators.

8. The turbine blade according to claim 1, wherein the cooling passage is a pass other than a last pass which is closest to a trailing edge among a plurality of passes constituting a serpentine passage formed inside the airfoil body, wherein the turbine blade comprises a plurality of last-pass turbulators disposed on suction-side and pressure-side inner wall surfaces of the last pass and arranged along the blade height direction, and wherein a height of each last-pass turbulator of the last pass in the blade height direction with reference to the second end portion is less than a height of a turbulator, disposed at the same position as the last-pass turbulator in the blade height direction, of another pass positioned on an upstream side in a cooling fluid flow direction.

9. The turbine blade according to claim 1, wherein the cooling passage is a pass other than a last pass which is closest to a trailing edge among a plurality of passes constituting a serpentine passage formed inside the airfoil body, wherein the turbine blade comprises a plurality of last-pass turbulators disposed on suction-side and pressure-side inner wall surfaces of the last pass and arranged along the blade height direction, and wherein a height of each last-pass turbulator of the last pass is less than a height of each turbulator of an upstream cooling passage positioned adjacent to an upstream side of the last pass in a cooling fluid flow direction and communicating with the last pass, among the plurality of passes.

10. The turbine blade according to claim 1, further comprising:

a leading-edge-side passage disposed inside the airfoil body on a leading edge side of the airfoil body with respect to the cooling passage, and extending along the blade height direction, and a plurality of leading-edge-side turbulators disposed on an inner wall surface of the leading-edge-side passage and arranged along the blade height direction, wherein, when e is a height of each turbulator or each leading-edge turbulator, and D is a passage width of the cooling passage or the leading-edge-side passage in the suction-pressure direction at a position of the turbulator or the leading-edge-side turbulator in the blade height direction, a relationship of $[(e/D)_{E2}/(e/D)_{AVE}] > [(e/D)_{L_E2}/(e/D)_{L_AVE}]$ is satisfied, where $(e/D)_{E2}$ is a ratio of the height to the passage width of a turbulator closest to the second end portion in the blade height direction among the plurality of turbulators, $(e/D)_{AVE}$ is an average of a ratio (e/D) of the height to the passage width of the plurality of turbulators, $(e/D)_{L_E2}$ is a ratio of the height to the blade width of a leading-edges-side turbulator closest to the second end portion in the blade height direction among the plurality of leading-edges-side turbulators, and $(e/D)_{L_AVE}$ is an average of a ratio $(e/D)_L$ of the height to the blade width of the plurality of leading-edges-side turbulators.

11. The turbine blade according to claim 1, wherein a flow-passage cross-sectional area of the cooling passage increases from the first end portion toward the second end portion in the blade height direction.

12. The turbine blade according to claim 1, wherein a relationship of $0.5 \leq \theta/\theta_{AVE} \leq 2.0$ is satisfied, where $\theta$ is an inclination angle of each of the plurality of turbulators with respect to a cooling fluid flow direction in the cooling passage, and $\theta_{AVE}$ is an average of the inclination angle of the plurality of turbulators.

13. The turbine blade according to claim 1, wherein the turbine blade is a rotor blade, and wherein the first end portion is positioned on a radially outer side of the second end portion.

14. The turbine blade according to claim 1, wherein the turbine blade is a stator blade, and wherein the first end portion is positioned on a radially inner side of the second end portion.

15. A gas turbine, comprising:

the turbine blade according to claim 1; and a combustor for producing a combustion gas flowing through a combustion gas passage in which the turbine blade is disposed.

* * * * *